US010919137B2

(12) United States Patent
Iida et al.

(10) Patent No.: US 10,919,137 B2
(45) Date of Patent: Feb. 16, 2021

(54) WORK TOOL

(71) Applicant: MAKITA CORPORATION, Anjo (JP)

(72) Inventors: Hitoshi Iida, Anjo (JP); Masanori Furusawa, Anjo (JP); Kei Watanabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 336 days.

(21) Appl. No.: 15/909,366

(22) Filed: Mar. 1, 2018

(65) Prior Publication Data

US 2018/0250802 A1 Sep. 6, 2018

(30) Foreign Application Priority Data

Mar. 3, 2017 (JP) ..... JP2017-040885

(51) Int. Cl.
*B25D 16/00* (2006.01)

(52) U.S. Cl.
CPC .... *B25D 16/006* (2013.01); *B25D 2216/0015* (2013.01); *B25D 2216/0023* (2013.01); *B25D 2216/0069* (2013.01); *B25D 2216/0084* (2013.01); *B25D 2250/261* (2013.01)

(58) Field of Classification Search
CPC ..... B25D 16/006; B25D 2216/0069
USPC ..... 173/47, 48, 170
See application file for complete search history.

(56) References Cited

U.S. PATENT DOCUMENTS 3,847,233 A * 11/1974 Glover ..... A01G 3/053 173/170
4,088,197 A * 5/1978 Roll ..... B25B 23/145 173/178
6,550,545 B1 * 4/2003 Manschitz ..... B25D 16/006 173/170

(Continued)

FOREIGN PATENT DOCUMENTS

DE 101 51 699 A1 5/2002
JP 2004-330379 A 11/2004

(Continued)

OTHER PUBLICATIONS

Oct. 21, 2020 Office Action issued in Japanese Patent Application No. 2017-040885.

*Primary Examiner* — Gloria R Weeks
(74) *Attorney, Agent, or Firm* — Oliff PLC

(57) ABSTRACT

A work tool, in which any one of a plurality of operation modes is selectable and which is configured to operate according to the selected operation mode, includes a switch for driving a tool accessory, an operation member, a mode switching member and a movement restricting mechanism. The operation member is configured to be held in an off-position in a non-pressed state and configured to move to an on-position in response to an external pressing operation. The mode switching member is configured to be switched between a plurality of switching positions in response to an external operation, the switching positions respectively corresponding to the operation modes. The movement restrict- (Continued)

ing mechanism is configured to restrict a movement of the operation member from the off-position to the on-position in interlock with a switching operation of the mode switching member.

18 Claims, 11 Drawing Sheets

(56) References Cited

U.S. PATENT DOCUMENTS

| | | | | |
|---|---|---|---|---|
| 7,316,529 | B2 * | 1/2008 | Phillips | B23B 31/008 144/136.95 |
| 7,828,073 | B2 * | 11/2010 | Liebert | B25D 16/006 173/162.1 |
| 7,931,095 | B2 * | 4/2011 | MacHida | B25D 11/062 173/104 |
| 8,028,760 | B2 * | 10/2011 | Yoshikane | B25D 16/006 173/104 |
| 8,286,724 | B2 * | 10/2012 | Furusawa | B25D 11/10 173/47 |
| 8,511,399 | B2 * | 8/2013 | Kunz | B25D 17/00 173/48 |
| 2002/0046847 | A1 | 4/2002 | Ichijyou et al. | |
| 2003/0226673 | A1 * | 12/2003 | Burger | B25D 16/00 173/48 |
| 2004/0020670 | A1 * | 2/2004 | Kusmierski | H01H 21/10 173/217 |
| 2006/0032645 | A1 | 2/2006 | Shimma et al. | |
| 2006/0060365 | A1 * | 3/2006 | Kunz | H01H 3/20 173/48 |
| 2008/0017396 | A1 * | 1/2008 | Kristen | B25D 16/006 173/162.2 |
| 2014/0138111 | A1 | 5/2014 | Takeuchi et al. | |
| 2016/0023344 | A1 * | 1/2016 | Bernhart | G05G 1/10 173/48 |

FOREIGN PATENT DOCUMENTS

| | | | |
|---|---|---|---|
| JP | 2006-026854 | A | 2/2006 |
| JP | 2008-221373 | A | 9/2008 |
| JP | 4729159 | B2 | 7/2011 |
| JP | 2014-100762 | A | 6/2014 |
| WO | 2008/111539 | A1 | 9/2008 |

* cited by examiner

WORK TOOL

CROSS-REFERENCE TO RELATED APPLICATION

The present application claims priority to Japanese patent application No. 2017-040885 filed on Mar. 3, 2017, contents of which are incorporated fully herein by reference.

TECHNICAL FIELD

The present invention relates to a work tool which is configured to operate according to an operation mode selected by a user from among a plurality of operation modes.

BACKGROUND

A work tool is known which is configured to operate according to an operation mode selected by a user from among a plurality of operation modes. For example, a hammer drill is capable of operating in a hammer mode (also referred to as a chisel mode) or a drill mode according to a user's selection. Further, for example, Japanese Patent No. 4729159 discloses a hammer drill which is configured to allow an operation member for a tool accessory driving switch to be locked in a state in which the operation member is pressed, in order to keep the switch in an on-state in the hammer mode, and not to allow the operation member to be locked in the drill mode.

SUMMARY

In the above-described hammer drill, the operation member can be locked in the hammer mode. This eliminates the need for the operation member to be held in a pressed state by a user, so that convenience is improved. Not only in hammer drills, but in other work tools which is configured to selectively operate in any of a plurality of operation modes, further improvement of convenience is desired.

Accordingly, it is an object of the present invention to provide a technique that may contribute to improvement of convenience, in a work tool which is configured to operate according to an operation mode selected by a user from among a plurality of operation modes.

One aspect of the present invention provides a work tool in which any one of a plurality of operation modes is selectable and which is configured to operate according to the selected operation mode. The work tool includes a switch, an operation member, a mode switching member and a movement restricting mechanism.

The switch is configured as a switch for driving a tool accessory. The operation member is configured to be held in an off-position in a non-pressed state, and configured to move to an on-position in response to an external pressing operation. The operation member in the off-position places the switch in an off-state, while the operation member in the on-position places the switch in an on-state. The mode switching member is configured to be switched between a plurality of switching positions in response to an external operation. The switching positions respectively correspond to the operation modes. The movement restricting mechanism is configured to restrict a movement of the operation member from the off-position to the on-position, in interlock with a switching operation of the mode switching member. To "restrict a movement" of the operation member here means to restrict a locational or spatial movement of the operation member according to a prescribed rule.

According to the present aspect, in interlock with the switching operation of the mode switching member, the movement restricting mechanism can restrict the movement of the operation member to the on-position for turning on the switch for driving a tool accessory. Therefore, in a case where the movement restricting mechanism is configured to restrict the movement of the operation member to the on-position, for example, corresponding to an operation mode in which the switch is preferred to be held in the off-position, the switch can be prevented from being turned on by an accidental operation of the operation member or other similar causes. In such a case, the user only needs to select a desired operation mode with the mode switching member. Thus, according to the present aspect, improvement of convenience can be realized in the work tool which is configured to operate according to an operation mode selected by a user from among a plurality of operation modes.

According to one aspect of the present invention, the operation modes may include a hammer mode and a drill mode, and the switching positions may include a hammer mode position corresponding to the hammer mode and a drill mode position corresponding to the drill mode. The hammer mode is an operation mode in which only a hammering operation of linearly driving the tool accessory in a direction of a prescribed driving axis is performed. The drill mode is an operation mode in which at least a drilling operation of rotationally driving the tool accessory around the driving axis is performed. The movement restricting mechanism may be configured to allow the movement of the operation member to the on-position in interlock with a switching operation of the mode switching member to the hammer mode position, and to prohibit the movement of the operation member to the on-position, in interlock with a switching operation of the mode switching member to the drill mode position, while allowing prohibition of the movement to be cancelled in response to an external operation.

The "drill mode" used in the present aspect may include: an operation mode in which only the drilling operation is performed; an operation mode in which both the drilling operation and the hammering operation are performed; and an operation mode in which the drilling operation as well as an operation other than the hammering operation are performed. The manner that the movement restricting mechanism "prohibits the movement of the operation member to the on-position" may include: the manner of prohibiting the operation member from moving from the off-position; and the manner of prohibiting the operation member from reaching the on-position while allowing the operation member to slightly move from the off-position. The structure of prohibiting the operation member from moving to the on-position is not particularly limited, but examples of possible structures may include: a structure that is configured to make contact with the operation member on a moving path of the operation member; and a structure that is configured to hold the operation member in the off-position in an immovable manner.

According to one aspect of the present invention, the movement restricting mechanism may include a restricting member and an interlocking member. The restricting member may be configured to be held in a prohibiting position in a non-pressed state, and configured to move from the prohibiting position to an allowing position in response to an external pressing operation. The prohibiting position is a position in which the restricting member prohibits the movement of the operation member to the on-position, and the allowing position is a position in which the restricting member allows the movement of the operation member to the on-position. The interlocking member may be configured to move in interlock with the switching operation of the mode switching member. The interlocking member may be configured to move to a separate position spaced apart from a moving path of the restricting member in interlock with the switching operation of the mode switching member to the drill mode position, thereby allowing the restricting member to move to the allowing position in response to the pressing operation. It is noted that, as a structure for holding the restricting member in the prohibiting position when the restricting member is not pressed, a biasing member (such as a spring) may be typically employed.

According to one aspect of the present invention, the interlocking member may be configured to move in contact with the restricting member to a first contact position on the moving path of the restricting member, in interlock with the switching operation of the mode switching member to the hammer mode position, thereby causing the restricting member to move to the allowing position. The interlocking member may be further configured to be in contact with the restricting member in the first contact position, thereby prohibiting the the restricting member from moving to the prohibiting position. The manner of "moving in contact" with the restricting member here does not necessarily require to be in contact with the restricting member throughout the whole process of the movement of the interlocking member to the first contact position, but it may also include the manner of moving in contact with the restricting member only in a certain period in this process.

According to one aspect of the present invention, the interlocking member may be configured to be movable in the direction of the driving axis and may have a first inclined surface. The first inclined surface may be inclined with respect to the driving axis. The restricting member may be configured to be movable in a direction crossing the driving axis and may have a second inclined surface. The second inclined surface may be configured to come into contact with the first inclined surface. Further, the interlocking member may be configured to move in the direction of the driving axis in a state in which the first inclined surface is in contact with the second inclined surface, in interlock with the switching operation of the mode switching member to the hammer mode position, thereby causing the restricting member to move to the allowing position.

According to one aspect of the present invention, the interlocking member may have a first vertical surface which extends generally perpendicular to a moving direction of the restricting member. The restricting member may have a second vertical surface which extends generally perpendicular to the moving direction of the restricting member. The interlocking member may be configured such that the first vertical surface is in contact with the second vertical surface in the first contact position, thereby prohibiting the the restricting member from moving to the prohibiting position.

According to one aspect of the present invention, the operation modes may include a drive prohibition mode in which driving of the tool accessory is prohibited, and the switching positions may include a drive prohibition mode position corresponding to the drive prohibition mode. The movement restricting mechanism may be configured to prohibit the movement of the operation member to the on-position, in interlock with a switching operation of the mode switching member to the drive prohibition mode position, while not allowing the prohibition of the movement to be cancelled.

According to one aspect of the present invention, the movement restricting mechanism may include a restricting member and an interlocking member. The restricting member may be configured to be held in a prohibiting position in a non-pressed state, and configured to move from the prohibiting position to an allowing position in response to an external pressing operation. The prohibiting position is a position in which the restricting member prohibits the movement of the operation member to the on-position, and the allowing position is a position in which the restricting member allows the movement of the operation member to the on-position. The interlocking member may be configured to move in interlock with the switching operation of the mode switching member. The interlocking member may be configured to move to a second contact position on the moving path of the restricting member in interlock with the switching operation of the mode switching member to the drive prohibition mode position. The interlocking member may be further configured to be in contact with the restricting member in the second contact position, thereby prohibiting the restricting member from moving to the allowing position.

According to one aspect of the present invention, the movement restricting mechanism may include a restricting member and an interlocking member. The restricting member may be configured to be held in a prohibiting position in a non-pressed state, and configured to move from the prohibiting position to an allowing position in response to an external pressing operation. The prohibiting position is a position in which the restricting member prohibits the movement of the operation member to the on-position, and the allowing position is a position in which the restricting member allows the movement of the operation member to the on-position. The interlocking member may be configured to move in interlock with the switching operation of the mode switching member. The interlocking member may be configured to move to a separate position spaced apart from a moving path of the restricting member in interlock with the switching operation of the mode switching member to the drill mode position, thereby allowing the restricting member to move to the allowing position in response to the pressing operation. The interlocking member may be configured to move in contact with the restricting member to a first contact position on the moving path of the restricting member, in interlock with the switching operation of the mode switching member to the hammer mode position, thereby causing the restricting member to move to the allowing position. The interlocking member may be further configured to be in contact with the restricting member in the first contact position, thereby prohibiting the the restricting member from moving to the prohibiting position. The interlocking member may be configured to move to a second contact position on the moving path of the restricting member in interlock with the switching operation of the mode switching member to the drive prohibition mode position. The interlocking member may be further configured to be in contact with the restricting member in the second contact position, thereby prohibiting the restricting member from moving to the allowing position.

According to one aspect of the present invention, the restricting member may include a first contacted part and a second contacted part different from the first contacted part. The interlocking member may include a first contact part and a second contact part. The first contact part may be configured to come into contact with the first contacted part in interlock with switching operation of the mode switching member to the hammer mode position. The second contact part may be configured to come into contact with the second contacted part in interlock with the switching operation of the mode switching member to the drive prohibition mode position.

According to one aspect of the present invention, the first and second contacted parts may be disposed in different positions of the restricting member in a crossing direction, and the first and second contact parts may be disposed in different positions of the interlocking member in the crossing direction. The crossing direction here is a direction crossing a moving direction of the restricting member as well as a moving direction of the interlocking member.

According to one aspect of the present invention, the interlocking member may be configured to move in the direction of the driving axis. The restricting member may be configured to move in an axial direction of a first axis, the first axis extending generally perpendicularly to the driving axis. The first contacted part may comprise a first passage. The first passage may extend through the restricting member in the direction of the driving axis. The second contacted part may comprise a second passage. The second passage may communicate with the first passage in an axial direction of a second axis, which extends perpendicular to the driving axis as well as the first axis. The second passage may extend through the restricting member in the direction of the driving axis and may have a different width from the first passage. The first contact part may be an elongate member extending in the direction of the driving axis and may be configured to pass through the first passage. The second contact part may be a projection protruding from the first contact part in the axial direction of the second axis and configured to pass through the second passage.

According to one aspect of the present invention, the first contacted part may comprise a first passage extending through the restricting member in a moving direction of the interlocking member. The second contacted part may comprise a second passage extending through the restricting member in the moving direction of the interlocking member, the second passage having a different width from the first passage. The first contact part may be configured to pass through the first passage. The first contact part may be configured to move to the first contact position in a state in which the first contact part is in contact with a wall surface of the first passage, in interlock with the switching operation of the mode switching member to the hammer mode position, thereby causing the restricting member to move to the allowing position. The first contact part may be further configured to be in contact with the wall surface of the first passage in the first contact position, thereby prohibiting the restricting member from moving to the prohibiting position. The second contact part may have a different width from the first contact part. The second contact part may be configured to pass through the second passage. The second contact part may be configured to move to the second contact position on the moving path of the restricting member, in interlock with the switching operation of the mode switching member to the drive prohibition mode position. The second contact part may be further configured to be in contact with a wall surface of the second passage in the second contact position, thereby prohibiting the movement of the restricting member to the allowing position.

According to one aspect of the present invention, the interlocking member may be configured to move in the direction of the driving axis. The restricting member may be configured to move in a direction crossing the driving axis. The first contact part may include a first vertical surface and a first inclined surface. The first vertical surface may extend generally perpendicularly to a moving direction of the restricting member. The first inclined surface may be inclined with respect to the driving axis. The wall surface of the first passage may include a second vertical surface and a second inclined surface. The second vertical surface may extend generally perpendicularly to the moving direction of the restricting member. The second inclined surface may be inclined with respect to the driving axis. The second inclined surface may be configured to make contact with the first inclined surface. The first inclined surface may be configured to move in contact with the second inclined surface to the first contact position in interlock with the switching operation of the mode switching member to the hammer mode position, thereby causing the restricting member to move to the allowing position. The first vertical surface may be configured to be in contact with the second vertical surface in the first contact position, thereby prohibiting the the restricting member from moving to the prohibiting position.

According to one aspect of the present invention, the second contact part may be a projection protruding from the first contact part.

According to one aspect of the present invention, the interlocking member may be configured to linearly move in the direction of the driving axis between the separate position, the first contact position and the second contact position, in interlock with the switching operation of the mode switching member.

According to one aspect of the present invention, the restricting member may be configured to move in a direction generally perpendicular to the driving axis.

According to one aspect of the present invention, the movement restricting mechanism may include a biasing member configured to bias the restricting member so as to hold the restricting member in the prohibiting position. The restricting member may be configured to be movable in a prescribed direction, and configured such that both ends of the restricting member in the prescribed direction are subject to the pressing operation, the prescribed direction crossing the driving axis. The allowing position may be provided on each side of the prohibiting position in the prescribed direction.

According to one aspect of the present invention, the work tool may further include a driving mechanism, a first housing and a second housing. The driving mechanism may be configured to drive the tool accessory. The first housing may house the driving mechanism. The second housing may include a grip part configured to be held by a user. The second housing may be connected to the first housing via an elastic element so as to be movable in the direction of the driving axis relative to the first housing. The interlocking member may be connected in an interlocking manner to the mode switching member provided to the first housing. The restricting member may be provided to the second housing so as to be movable in a direction crossing the driving axis. The interlocking member may include a sliding part. The sliding part may be configured to slide in the direction of the driving axis relative to the restricting member when the second housing moves relative to the first housing in the direction of the driving axis in a state in which the interlocking member is disposed in the first contact position in the hammer mode.

DETAILED DESCRIPTION OF THE EMBODIMENTS

An embodiment is now described with reference to the drawings. In the following embodiment, a hammer drill 1 is described as an example of a work tool in which any one of a plurality of operation modes is selectable and which is configured to operate according to the selected operation mode. The hammer drill 1 of the present embodiment is configured to perform an operation (hereinafter referred to as a hammering operation) of linearly driving a tool accessory 18 coupled to a tool holder 34 along a prescribed driving axis A1, and an operation (hereinafter referred to as a drilling operation) of rotationally driving the tool accessory 18 around the driving axis A1.

Figure 1:
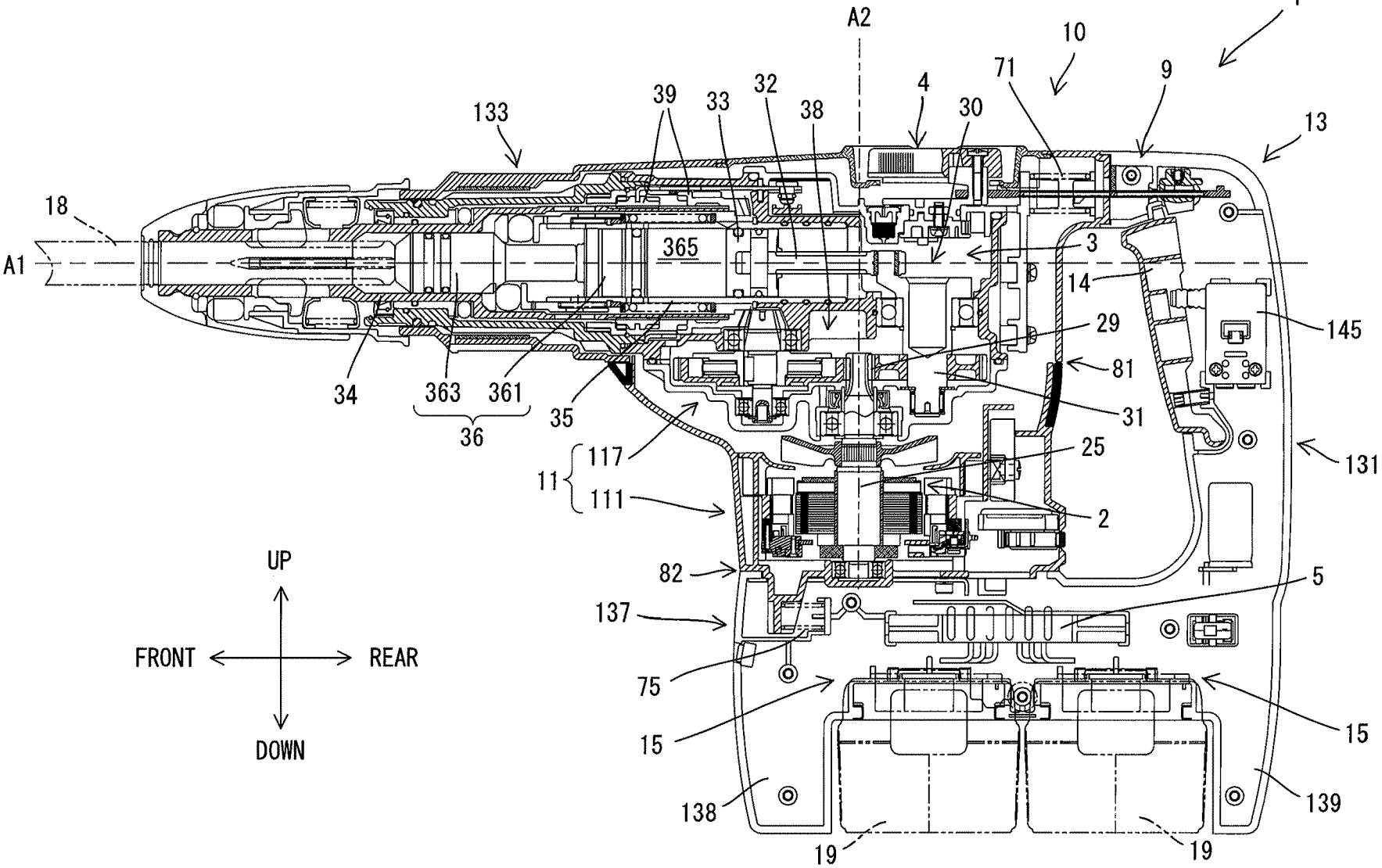
FIG. 1 is a longitudinal sectional view of a hammer drill.

First, the general structure of the hammer drill 1 is described with reference to FIG. 1. As shown in FIG. 1, an outer shell of the hammer drill 1 is mainly formed by a housing 10. The housing 10 of the present embodiment is configured as a so-called vibration-isolation housing, and includes a first housing 11 and a second housing 13 which is elastically and movably connected to the first housing 11.

The first housing 11 includes a motor housing part 111 and a driving mechanism housing part 117. The motor housing part 111 houses a motor 2. The driving mechanism housing part 117 houses a driving mechanism 3 that is configured to drive the tool accessory 18 by power of the motor 2. The first housing 11 is generally L-shaped as a whole. The driving mechanism housing part 117 has an elongate shape extending in a direction of the driving axis A1 (hereinafter also referred to as a driving axis A1 direction). A tool holder 34 is disposed in one end region of the driving mechanism housing part 117 in the driving axis A1 direction. The tool accessory 18 can be removably coupled to the tool holder 34. The motor housing part 111 is fixedly connected in a relatively immovable manner to the other end region of the driving mechanism housing part 117 in the driving axis A1 direction. Further, the motor housing part 111 is arranged to protrude in a direction crossing the driving axis A1 and away from the driving axis A1. The motor 2 is disposed in the motor housing part 111 such that a rotation axis A2 of a motor shaft 25 extends in a direction perpendicular to the driving axis A1.

In the following description, for the sake of explanation, the driving axis A1 direction of the hammer drill 1 is defined as a front-rear direction of the hammer drill 1. One end side of the hammer drill 1 on which the tool holder 34 is disposed is defined as a front side (also referred to as a front end region side) of the hammer drill 1 and the opposite side is defined as a rear side. Further, an extending direction of the rotation axis A2 (hereinafter also referred to as a rotation axis A2 direction) of the motor shaft 25 is defined as an up-down direction of the hammer drill 1, a direction toward which the motor housing part 111 protrudes from the driving mechanism housing part 117 is defined as a downward direction and the opposite direction is defined as an upward direction.

The second housing 13 includes a grip part 131, an upper part 133 and a lower part 137. The second housing 13 is generally U-shaped as a whole. The grip part 131 is configured to be held by a user and arranged to extend in the direction of the rotation axis A2 of the motor shaft 25 (that is, the up-down direction). More specifically, the grip part 131 is arranged apart rearward from the first housing 11 and extends in the up-down direction. A trigger 14 is provided on a front portion of the grip part 131. The trigger 14 is configured to be pressed (pulled) with a user's finger. The upper part 133 is connected to an upper end portion of the grip part 131. In the present embodiment, the upper part 133 is configured to extend forward from the upper end portion of the grip part 131 and cover the most part of the driving mechanism housing part 117 of the first housing 11. The lower part 137 is connected to a lower end portion of the grip part 131. In the present embodiment, the lower part 137 extends forward from the lower end portion of the grip part 131 and is arranged on a lower side of the motor housing part 111. Battery mounting parts 15 are provided on a lower end portion of a central region of the lower part 137 in the front-rear direction. The hammer drill 1 can be operated by a power supply from batteries 19 mounted to the battery mounting parts 15.

With the above-described structure, in the hammer drill 1, the motor housing part 111 of the first housing 11 is arranged between the upper part 133 and the lower part 137 in the up-down direction and exposed to the outside and forms an outer surface of the hammer drill 1 together with the second housing 13.

The structure of the hammer drill 1 is now described in detail. First, a vibration-isolation housing structure of the housing 10 is briefly described with reference to FIG. 1. As described above, in the housing 10, the second housing 13 including the grip part 131 is elastically connected to the first housing 11 such that the second housing 13 is movable relative to the first housing 11 which houses the motor 2 and the driving mechanism 3, so that transmission of vibration from the first housing 11 to the second housing 13 (particularly, to the grip part 131) is suppressed.

More specifically, as shown in FIG. 1, a pair of right and left first springs 71 are disposed between the driving mechanism housing part 117 of the first housing 11 and the upper part 133 of the second housing 13. Further, a second spring 75 is disposed between the motor housing part 111 of the first housing 11 and the lower part 137 of the second housing 13. In the present embodiment, the first springs 71 and the second spring 75 are configured as compression coil springs, and bias the first housing 11 and the second housing 13 such that the grip part 131 is separated away from the first housing 11 in the driving axis A1 direction.

Further, the upper and lower parts 133, 137 are configured to be slidable relative to the upper and lower end portions of the motor housing part 111, respectively. More specifically, a lower surface of the upper part 133 and an upper end surface of the motor housing part 111 are configured as sliding surfaces to make sliding contact with each other in the driving axis A1 direction, and form an upper sliding part 81. Further, an upper surface of the lower part 137 and a lower end surface of the motor housing part 111 are configured as sliding surfaces to make sliding contact with each other in the driving axis A1 direction, and form a lower sliding part 82. Each of the upper sliding part 81 and the lower sliding part 82 serves as a sliding guide for guiding the first housing 11 and the second housing 13 to move relative to each other in the driving axis A1 direction. With this structure, vibration in the driving axis A1 direction, which is the largest and most dominant vibration caused during the hammering operation, can be effectively prevented from being transmitted to the grip part 131.

Next, the detailed structure of the first housing 11 and an internal configuration of the first housing 11 are described with reference to FIG. 1.

First, the motor housing part 111 and its internal configuration are described. As shown in FIG. 1, the motor housing part 111 has a bottomed rectangular tube shape having an open upper end. In the present embodiment, as the motor 2, a compact and high-output brushless motor is disposed in the motor housing part 111. The motor shaft 25 that extends in the up-down direction is rotatably supported at its upper and lower end portions by bearings. A driving gear 29 is formed on the upper end portion of the motor shaft 25 which protrudes into the driving mechanism housing part 117.

The driving mechanism housing part 117 and its internal configuration are described. As shown in FIG. 1, a lower end region of a rear portion of the driving mechanism housing part 117 is disposed within an upper end region of the motor housing part 111, and the driving mechanism housing part 117 is fixedly connected to the motor housing part 111 in a relatively immovable manner. The driving mechanism housing part 117 houses a driving mechanism 3. The driving mechanism 3 includes a motion converting mechanism 30, a striking mechanism 36 and a rotation transmitting mechanism 38.

The motion converting mechanism 30 is configured to convert a rotational motion of the motor 2 into a linear motion and then transmit the motion to the striking mechanism 36. In the present embodiment, the motion converting mechanism 30 is configured as a crank mechanism. More specifically, the motion converting mechanism 30 includes a crank shaft 31, a connecting rod 32, a piston 33 and a cylinder 35. The crank shaft 31 is arranged in parallel to the motor shaft 25 in a rear end region of the driving mechanism housing part 117. The crank shaft 31 has a driven gear 311 which is engaged with the driving gear 29, and an eccentric pin. One end portion of the connecting rod 32 is connected to the eccentric pin and the other end portion is connected to the piston 33 via a connecting pin. The piston 33 is slidably disposed within the cylinder 35 which has a circular cylindrical shape. The cylinder 35 is coaxially and fixedly connected to a rear portion of the tool holder 34, which is disposed within a front end region of the driving mechanism housing part 117. When the motor 2 is driven, the piston 33 is caused to reciprocate within the cylinder 35 in the driving axis A1 direction.

The striking mechanism 36 includes a striker 361 and an impact bolt 363. The striker 361 is disposed within the cylinder 35 so as to be slidable in the driving axis A1 direction. An air chamber 365 is formed between the striker 361 and the piston 33. The air chamber 365 serves to linearly move the striker 361, which is a striking element, via air pressure fluctuations caused by the reciprocating movement of the piston 33. The impact bolt 363 is configured as an intermediate element for transmitting kinetic energy of the striker 361 to the tool accessory 18. The impact bolt 363 is disposed within the tool holder 34 so as to be slidable in the driving axis A1 direction.

When the motor 2 is driven and the piston 33 is moved forward, air in the air chamber 365 is compressed so that the internal pressure increases. Therefore, the striker 361 is pushed forward at high speed and collides with the impact bolt 363, thereby transmitting its kinetic energy to the tool accessory 18. As a result, the tool accessory 18 is linearly driven along the driving axis A1 and strikes a workpiece. On the other hand, when the piston 33 is moved rearward, the air in the air chamber 365 expands so that the internal pressure decreases and the striker 361 is retracted rearward. By repeating such operations of the motion converting mechanism 30 and the striking mechanism 36, the hammer drill 1 performs hammering operation.

The rotation transmitting mechanism 38 is configured to transmit the rotating power of the motor shaft 25 to the tool holder 34. In the present embodiment, the rotation transmitting mechanism 38 is configured as a gear speed reducing mechanism including a plurality of gears. The rotation transmitting mechanism 38 appropriately decelerates the speed of the rotation and transmit the rotating power of the motor 2 to the tool holder 34. Further, an engagement clutch 39 is disposed on a power transmission path of the rotation transmitting mechanism 38. When the clutch 39 is engaged, the rotating power of the motor shaft 25 is transmitted to the tool holder 34 via the rotation transmitting mechanism 38, so that the tool accessory 18 coupled to the tool holder 34 is rotationally driven around the driving axis A1. When the clutch 39 is disengaged (as shown in FIG. 1), power transmission to the tool holder 34 via the rotation transmitting mechanism 38 is interrupted, so that the tool accessory 18 is not rotationally driven.

The hammer drill 1 of the present embodiment is configured such that one of three operation modes, that is, a hammer drill mode, a hammer mode and a trigger lock mode, can be selected by operating a mode switching dial 4. The mode switching dial 4 is rotatably disposed on the top of the driving mechanism housing part 117. In the hammer drill mode, the clutch 39 is engaged and the motion converting mechanism 30 and the rotation transmitting mechanism 38 are driven, so that the hammering operation and the drilling operation are performed. In the hammer mode, the clutch 39 is disengaged and only the motion converting mechanism 30 is driven, so that only the hammering operation is performed. In the trigger lock mode, driving of the tool accessory 18 is prohibited, that is, the hammering operation and the drilling operation are prohibited from being performed.

A clutch switching mechanism is provided within the first housing 11 (specifically, within the driving mechanism housing part 117). The clutch switching mechanism is connected to the mode switching dial 4, and configured to switch the clutch 39 between the engaged state and the disengaged state according to a selected switching position, when a hammer drill position or a hammer position is selected with the mode switching dial 4. The structure of such a clutch switching mechanism is well known, and therefore it is not described here in further detail and not shown in the drawings.

The detailed structure of the second housing 13 and their internal configuration of the second housing 13 are now described with reference to FIGS. 1 to 3.

First, the upper part 133 and its internal configuration are described. As shown in FIG. 1, a rear portion of the upper part 133 has a generally rectangular box-like shape having an open bottom, and covers a rear portion of the driving mechanism housing part 117 (more specifically, a portion of the driving mechanism housing part 117 in which the motion converting mechanism 30 and the rotation transmitting mechanism 38 are housed) from above. Further, a front portion of the upper part 133 is cylindrically shaped, and covers an outer periphery of a front portion of the driving mechanism housing part 117 (more specifically, a portion of the driving mechanism housing part 117 in which the tool holder 34 is housed).

Figure 2:
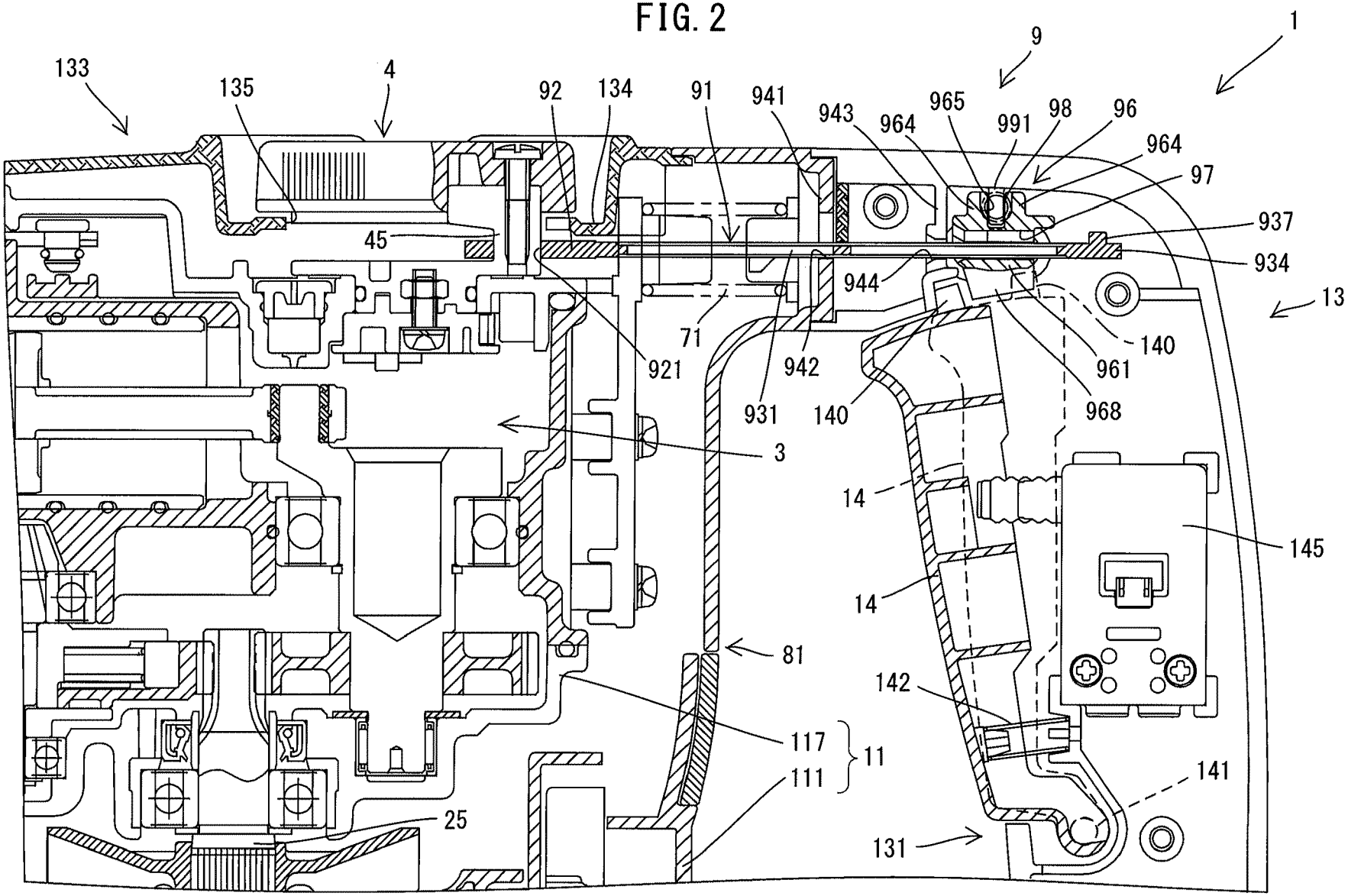
FIG. 2 is an enlarged view of an upper rear end portion in FIG. 1.

As shown in FIG. 2, a recess 134, which is recessed downward, is formed by an upper surface of the rear portion of the upper part 133. An opening 135 is formed in a bottom of the recess 134 such that the mode switching dial 4 provided on the top portion of the driving mechanism housing part 117 is exposed to the outside through the opening 135. The mode switching dial 4 protrudes into the recess 134 through the opening 135.

Figure 3:
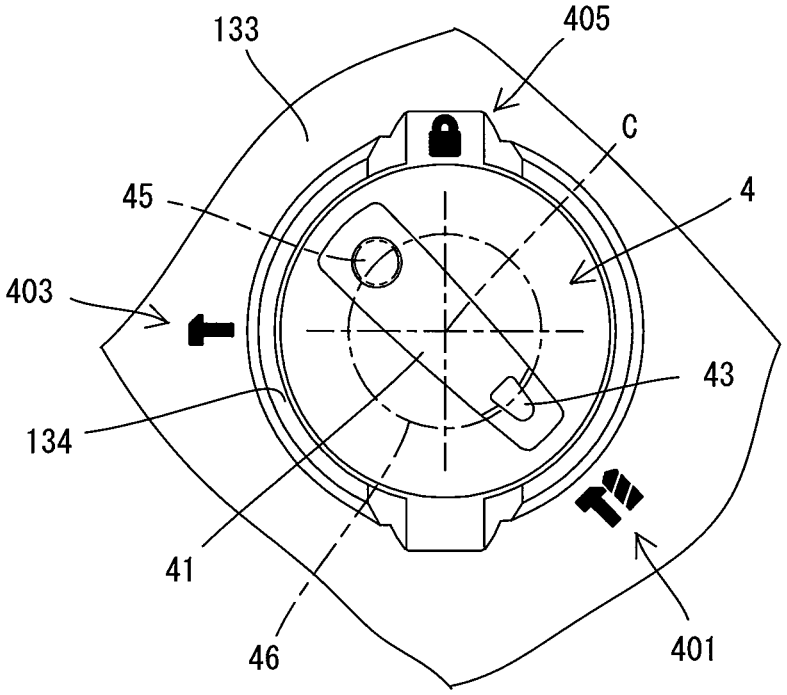
FIG. 3 is a plan view showing a mode switching dial.

As shown in FIG. 3, marks 401, 403, 405 for indicating switching positions of the mode switching dial 4 are provided on a peripheral portion of the recess 134 of the upper part 133. Specifically, the mode switching dial 4 has different switching positions in the circumferential direction, corresponding to the hammer drill mode, the hammer mode and the trigger lock mode, respectively. The mark 401 of a hammer and a drill, the mark 403 of a hammer and the mark 405 of a lock are respectively provided at positions corresponding to the switching positions. The user can select an operation mode by holding and turning a tab 41 of the mode switching dial 4 and pointing a pointer 43 of the tab 41 to a switching position (any one of the marks 401, 403, 405) corresponding to a desired operation mode. The switching positions corresponding to the hammer drill mode, the hammer mode and the trigger lock mode are hereinafter referred to as a hammer drill position, a hammer position and a trigger lock position, respectively.

As shown in FIG. 2, a trigger restricting mechanism 9 is disposed within the rear portion of the upper part 133. The trigger restricting mechanism 9 is connected to the mode switching dial 4. The trigger restricting mechanism 9 is configured to restrict a movement of the trigger 14 according to the operation mode selected with the mode switching dial 4 by the user. The trigger restricting mechanism 9 is described below in further detail.

The grip part 131 and its internal configuration are now described. As shown in FIG. 2, the trigger 14, which can be pressed (pulled) by the user, is provided on the front portion of the grip part 131. The trigger 14 is configured to be turned (rotated) in the front-rear direction within a prescribed turning range, around a support shaft 141 which extends in the left-right direction. The trigger 14 is normally (in a non-pressed state) held in a foremost position (a position shown by a solid line in FIG. 2) within the turning range in a state in which the trigger 14 is biased forward by a biasing spring 142. Upwardly protruding locking projections 140 are provided on an upper end of the trigger 14. In the present embodiment, two locking projections 140 are provided and spaced apart from each other in the left-right direction (see FIG. 5). The locking projections 140 are configured to be engaged with a restricting member 96 which is described below. This structure is described below in detail.

A switch 145 is provided within the cylindrical grip part 131. The switch 145 is configured to be switched between an on-state and an off-state in response to an operation of the trigger 14. When the trigger 14 is in the non-pressed state, in which the trigger 14 is placed in the foremost position, a movable contact of the switch 145 does not make contact with a fixed contact of the switch 145, so that the switch 145 is kept in the off-state. The foremost position of the trigger 14 is hereinafter also referred to as an off-position. When the trigger 14 is pressed and turned rearward to a specific position (a position shown by a dotted line in FIG. 2) within the turning range, the movable contact is brought into contact with the fixed contact by a movement of the plunger of the switch 145, so that the switch 145 is turned to the on-state. This specific position of the trigger 14 is also referred to as an on-position. Further, in the present embodiment, a rearmost position of the trigger 14 within the turning range, which is not shown, is set slightly rearward of the on-position. The switch 145 is kept in the off-state when the trigger 14 is located between the off-position (foremost position) and the on-position within the turning range, while the switch 145 is kept in the on-state when the trigger 14 is located between the on-position and the rearmost position.

The lower part 137 and its internal configuration are now described. As shown in FIG. 1, the lower part 137 has a rectangular box-like shape having a partly open top. The lower part 137 is arranged on the lower side of the motor housing part 111. A controller 5 is disposed within the lower part 137. The controller 5 is electrically connected to the motor 2, the switch 145 and the battery mounting parts 15 via wiring (not shown). The controller 5 is configured to start energization of the motor 2 (in other words, driving of the tool accessory 18) when the trigger 14 is pressed and the switch 145 is turned on. The controller 5 is also configured to stop energization of the motor 2 when the trigger 14 is released and the switch 145 is turned off.

Further, two battery mounting parts 15, to which the rechargeable batteries 19 can be removably mounted, are provided on the lower end portion of the central region of the lower part 137 in the front-rear direction as described above. In the present embodiment, the two battery mounting parts 15 are disposed side by side in the front-rear direction. The battery 19 can be slid rightward from the left of the battery mounting part 15 and engaged therewith, and at the same time, electrically connected to the battery mounting part 15. When two such batteries 19 are mounted to the battery mounting parts 15, lower surfaces of the batteries 19 are flush with each other. Further, a front lower end part 138 and a rear lower end part 139 of the lower part 137 are configured to be arranged respectively on the front side and the rear side of the pair of the batteries 19 mounted to the battery mounting part 6 and configured such that their lower surfaces are substantially flush with the lower surfaces of the batteries 19. The front and rear lower end parts 138, 139 serve as battery protection parts for protecting the batteries 19 against an external force.

The trigger restricting mechanism 9 is now described in detail. In the present embodiment, the trigger restricting mechanism 9 includes an interlocking member 91 and a restricting member 96.

Figure 4:
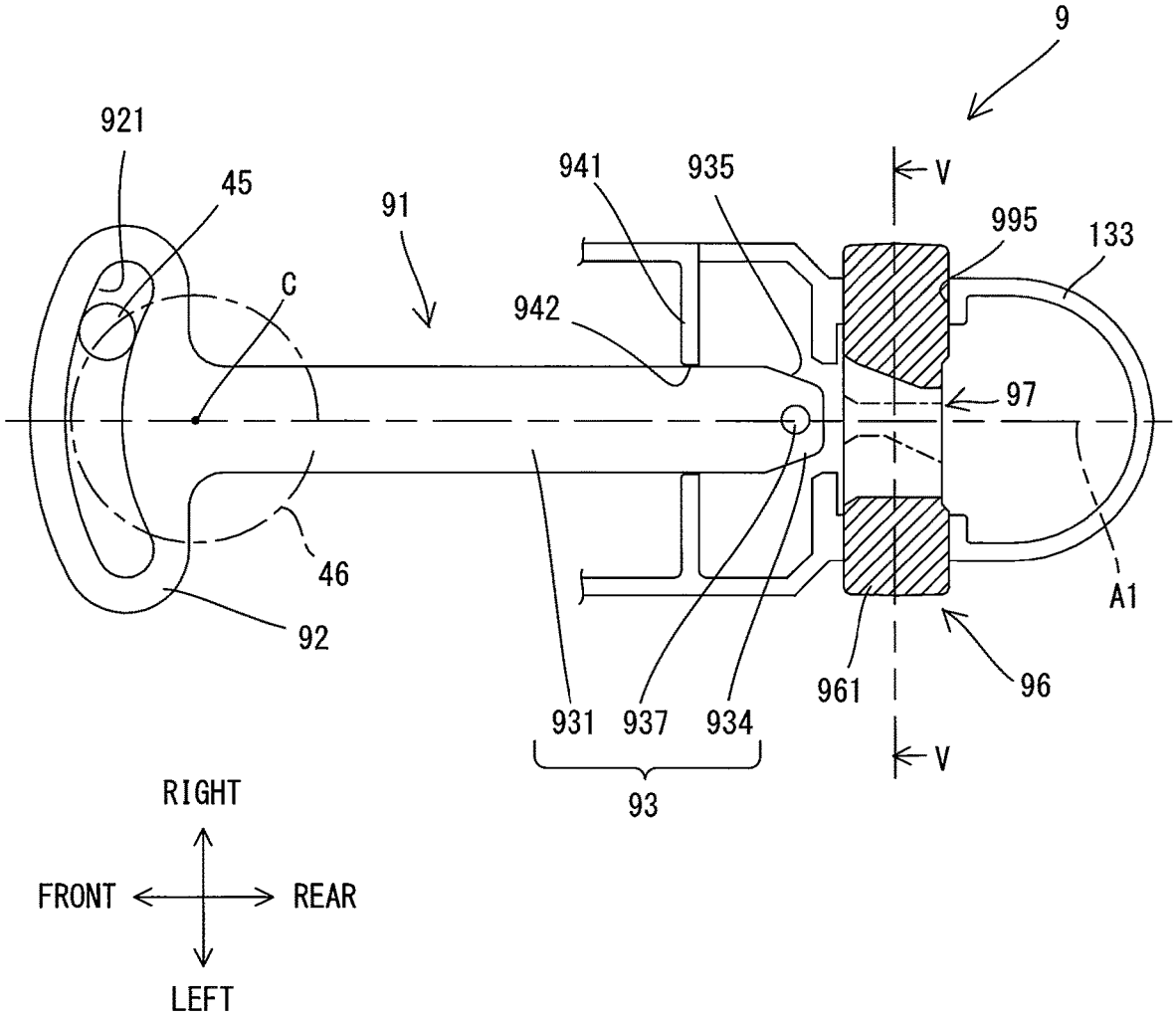
FIG. 4 is an explanatory drawing for illustrating an arrangement of a trigger restricting mechanism in a hammer drill mode.

First, the interlocking member 91 is described with reference to FIGS. 2 and 4. The interlocking member 91 is configured to move in interlock with a switching operation of the mode switching dial 4. In the present embodiment, as shown in FIGS. 2 and 4, the interlocking member 91 is configured as an elongate member which is arranged to extend in the driving axis A1 direction (the front-rear direction). The interlocking member 91 includes a connection part 92 and an actuation part 93.

The connection part 92 is a portion that is connected to the mode switching dial 4 (see FIG. 3) in a relatively movable manner. The connection part 92 is a front end portion of the interlocking member 91 and has a circular-arc shape bulging forward. The connection part 92 has a guide hole 921 formed as a correspondingly shaped circular-arc slot. The mode switching dial 4 has a circular columnar eccentric shaft 45 which protrudes downward from a position deviated a predetermined distance from a rotation center C of the mode switching dial 4. The eccentric shaft 45 is inserted through the guide hole 921 in the up-down direction and can slide within the guide hole 921.

The actuation part 93 linearly protrudes rearward from a central part of the inner side of the circular-arc connection part 92, and extends in the front-rear direction along the driving axis A1. The actuation part 93 includes a straight part 931, a tapered part 934 and a locking projection 937. The straight part 931 is a portion that extends rearward from the connection part 92 and that has a prescribed width in the left-right direction. The tapered part 934 is a portion that is tapered rearward from the straight part 931. The locking projection 937 is a pin-shaped portion that protrudes upward from the tapered part 934. In the present embodiment, the actuation part 93 is symmetrically formed in the left-right direction, with respect to the driving axis A1 and the locking projection 937 is arranged on the driving axis A1.

The straight part 931 is configured to come into contact with the restricting member 96 in the left-right direction to thereby prohibit the restricting member 96 from moving in the left-right direction. The tapered part 934 is configured to move rearward in contact with the restricting member 96 to thereby cause the restricting member 96 to move to the right. The locking projection 937 is configured to come into contact with the restricting member 96 in the left-right direction to thereby prohibit the restricting member 96 from moving in the left-right direction. The locking projection 937, however, prohibits a movement of the restricting member 96 in a different manner from the straight part 931. The operation of the interlocking member 91 with respect to the restricting member 96 is described below in further detail.

In the present embodiment, the interlocking member 91 is disposed to be movable in the driving axis A1 direction (the front-rear direction) within a prescribed moving range. To this end, as shown in FIGS. 2 and 4, a guide wall 941 for guiding the movement of the interlocking member 91 is provided in the rear end portion of the upper part 133 of the second housing 13. The guide wall 941 is arranged to extend perpendicularly to the driving axis A1. A passage 942 is formed in the center of the guide wall 941 in the left-right direction. The passage 942 extends through the guide wall 941 in the front-rear direction. The height of the passage 942 in the up-down direction is larger than the thickness of a portion of the actuation part 93 where the locking projection 937 is disposed, in the up-down direction (see FIG. 2). Further, the width of the passage 942 in the left-right direction is substantially equal to the width of the straight part 931 in the left-right direction (see FIG. 4). The straight part 931 is disposed to be always located in the passage 942 such that right and left side surfaces of the straight part 931 can slide along the guide wall 941. When the mode switching dial 4 is turned around the rotation center C, the interlocking member 91 is moved in the front-rear direction while sliding with respect to the guide wall 941, by a front-rear directional component of a rotational movement of the eccentric shaft 45.

Further, as shown in FIG. 2, a pair of guide ribs 943 are provided behind the guide wall 941. The guide ribs 943 protrude inward from right and left inner side surfaces of the upper part 133 (only the right guide rib 943 is shown). Each of the guide ribs 943 has a passage 944 through which a right or left edge portion of the actuation part 93 can pass in the front-rear direction. The height of the passage 944 in the up-down direction is slightly larger than the thickness of the right and left edge portions (that is, a portion which does not have the locking projection 937) of the actuation part 93 in the up-down direction. A front open end portion of the passage 944 is enlarged in the up-down direction toward the front end. The actuation part 93 may move in and out of the passage 944 and a locking passage 97 as the interlocking member 91 moves in the front-rear direction, which is described below in detail. At this time, the guide ribs 943 can guide the movement of the actuation part 93 from above and below.

Figure 5:
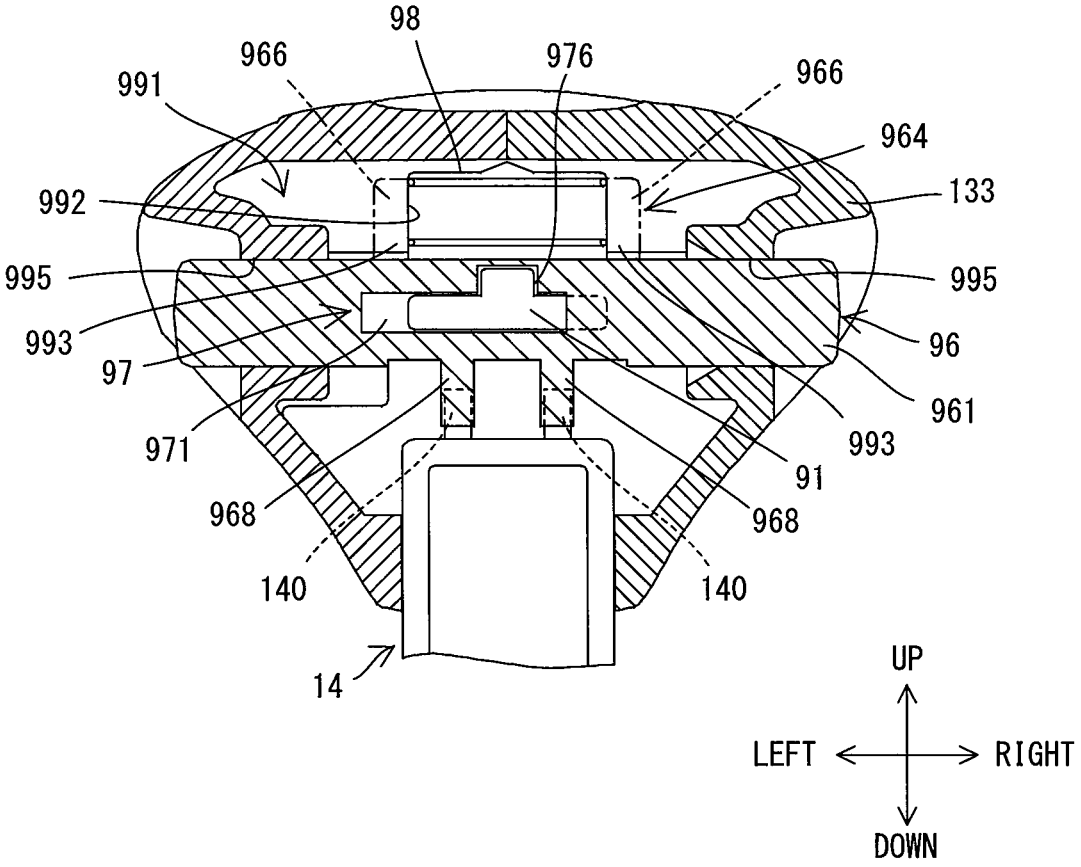
FIG. 5 is a sectional view taken along line V-V in FIG. 4, for illustrating the state of a restricting member when an interlocking member is disposed in a separate position.
Figure 6:
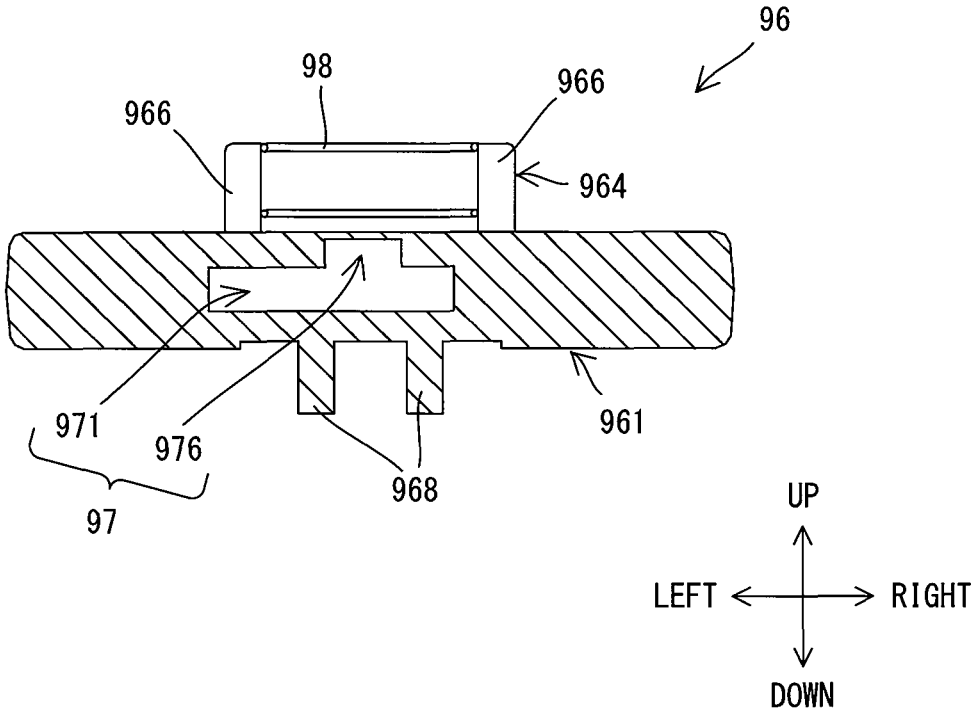
FIG. 6 is a longitudinal sectional view of the restricting member.

The restricting member 96 is now described with reference to FIGS. 2 and 5 to 7. The restricting member 96 is a member that is configured to prohibit or allow a movement of the trigger 14 from the off-position to the on-position. More specifically, the restricting member 96 is configured to move between a prohibiting position, in which the restricting member 96 prohibits the movement of the trigger 14 to the on-position, and an allowing position, in which the restricting member 96 allows the movement of the trigger 14 to the on-position, in response to an external pressing operation. As shown in FIG. 6, in the present embodiment, the restricting member 96 includes a body 961, a spring holding part 964 and trigger locking pieces 968.

The body 961 has a rod-like shape extending in the left-right direction. The body 961 has the locking passage 97 that extends through the body 961 in the driving axis A1 direction (the front-rear direction). In the present embodiment, the locking passage 97 includes a first locking part 971 and a second locking part 976.

Figure 7:
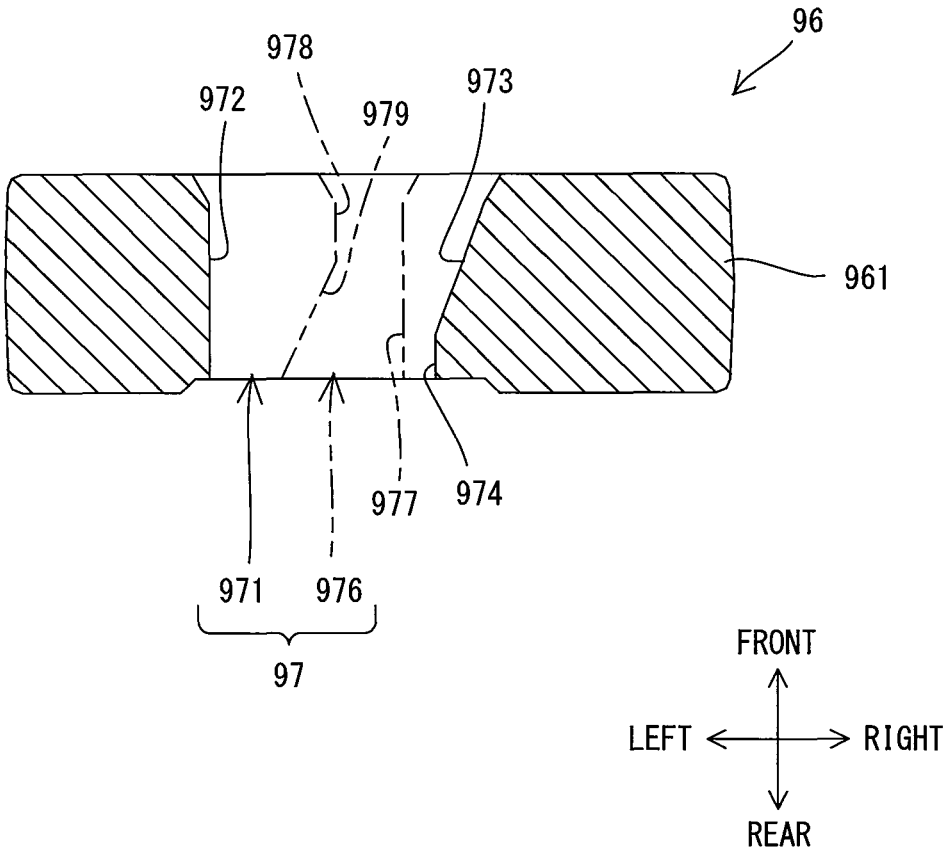
FIG. 7 is a cross sectional view of the restricting member.

The first locking part 971 is a lower portion of the locking passage 97 and the height of the first locking part 971 in the up-down direction is substantially equal to the thickness of the portion of the actuation part 93 where the locking projection 937 is not disposed, in the up-down direction. Further, as shown in FIG. 7, the width of the first locking part 971 in the left-right direction is not constant in the front-rear direction. Specifically, a front open end portion of the first locking part 971 is enlarged in the left-right direction toward the front end, and the width of the first locking part 971 in the left-right direction gradually decreases from the front open end portion toward a rear end portion and becomes constant in the rear end portion.

More specifically, a left wall surface of the first locking part 971 except for the front open end portion is configured as a vertical surface 972 that extends generally perpendicularly to a moving direction of the restricting member 96. A right wall surface of the first locking part 971 includes a tapered surface 973 and a vertical surface 974. The tapered surface 973 is inclined in a direction toward the vertical surface 972 (leftward), as the tapered surface 973 extends toward the rear. The vertical surface 974 extends continuously from the rear end of the tapered surface 973 and extends substantially in parallel to the vertical surface 972 of the left wall surface. The inclination angle of the tapered surface 973 with respect the driving axis A1 is substantially equal to the inclination angle of both side surfaces of the tapered part 934 of the interlocking member 91 with respect the driving axis A1. The distance between the tapered surface 973 and the vertical surface 972 in the left-right direction is set larger than the width of the straight part 931 of the interlocking member 91 in the left-right direction. The distance between the vertical surface 974 and the vertical surface 972 in the left-right direction is set slightly larger than the width of the straight part 931 in the left-right direction.

In the hammer mode, the tapered surface 973 may come into contact with the tapered part 934 when the interlocking member 91 causes the restricting member 96 to move, and the vertical surfaces 972, 974 may come into contact with side surfaces of the straight part 931 and prohibit the movement of the restricting member 96 in the left-right direction. These features are described below in further detail.

As shown in FIG. 6, the second locking part 976 is an upper portion of the locking passage 97 and the height of the second locking part 976 in the up-down direction is substantially equal to the protruding height of the locking projection 937 protruding from the upper surface of the tapered part 934. In other words, the height of the locking passage 97 as a whole in the up-down direction is substantially equal to the largest thickness of the interlocking member 91 in the up-down direction (see FIG. 5). Further, as shown in FIG. 7, like the first locking part 971, the width of the second locking part 976 in the left-right direction also changes in the front-rear direction. Specifically, a front open end portion of the second locking part 976 is enlarged in the left-right direction toward the front end, and the width of the second locking part 976 becomes constant in a certain portion extending rearward from the front open end portion and then gradually increases toward the rear end.

More specifically, a right wall surface of the second locking part 976 except for the front open end portion is configured as a vertical surface 977 that extends generally perpendicularly to the moving direction of the restricting member 96. A left wall surface of the second locking part 976 includes a vertical surface 978 and a tapered surface 979. The vertical surface 978 extends rearward from the front open end portion, in parallel to the vertical surface 977 of the right wall surface. The tapered surface 979 extends continuously from the rear end of the vertical surface 978 and is inclined in a direction away from the driving axis A1 (leftward), as the tapered surface 979 extends toward the rear. The distance between the vertical surface 977 and the vertical surface 978 in the left-right direction is set slightly larger than the width of the locking projection 937 of the interlocking member 91 in the left-right direction. The distance between the vertical surface 977 and the tapered surface 979 in the left-right direction is set larger than the width of the locking projection 937 in the left-right direction. Further, the vertical surfaces 977, 978 are arranged symmetrically with respect to a center line of the restricting member 96 in the left-right direction. The inclination angle of the tapered surface 979 with respect the driving axis A1 is substantially equal to the inclination angle of the tapered surface 973 with respect the driving axis A1.

In the trigger lock mode, the vertical surfaces 977, 978 may come into contact with a side surface of the locking projection 937 and prohibit the movement of the restricting member 96 in the left-right direction. In the hammer mode, the tapered surface 979 may serve as an escape surface for the locking projection 937 when the interlocking member 91 causes the restricting member 96 to move. These features are described below in further detail.

As shown in FIGS. 2 and 6, the spring holding part 964 protrudes upward from an upper end portion of the body 961, in the center region in the left-right direction. The spring holding part 964 is configured to hold a biasing member 98. The spring holding part 964 has a recess 965 (see FIG. 2) extending in the left-right direction and having a U-shape in side view. Each of left and right end portions of the spring holding part 964 has a stopper part 966 slightly protruding into the recess 965. In the present embodiment, the biasing member 98 is configured as a compression coil spring. The biasing member 98 is held within the recess 965 of the spring holding part 964 in a compressed state, with its left and right ends in contact with the stopper parts 966.

The trigger locking piece 968 is configured to be engaged with the locking projection 140 of the trigger 14. In the present embodiment, as shown in FIG. 6, the trigger locking pieces 968 are configured as two projection pieces projecting downward from a lower end of the body 961. The two trigger locking pieces 968 are spaced apart from each other in the left-right direction and the distance between the trigger locking pieces 968 is set longer than the width of the locking projection 140 of the trigger 14 in the left-right direction. As shown in FIG. 5, the distance between the two locking projections 140 of the trigger 14 in the left-right direction is set longer than the width of the trigger locking piece 968 in the left-right direction. Further, the width of the trigger locking piece 968 in the left-right direction is set generally equal to the width of the locking projection 140 in the left-right direction.

As shown in FIG. 5, the restricting member 96 having the above-described structure is disposed in the rear end portion of the upper part 133 so as to be movable in the left-right direction crossing the driving axis A1 direction. More specifically, each of left and right walls of the upper part 133 has a through hole 995 formed therethrough on the rear side of the guide rib 943 (see FIG. 2). The restricting member 96 is held by the upper part 133 so as to be movable in the left-right direction with left and right end portions of the body 961 protruding to the outside through the through holes 135.

Further, as shown in FIG. 2, a restricting wall 991 is formed on an upper wall of the upper part 133. The restricting wall 991 protrudes downward, facing the recess 965 of the spring holding part 964. As shown in FIG. 5, the restricting wall 991 has a recess 992 formed in its central portion. The recess 992 is recessed upward to a position corresponding to an upper end of the spring holding part 964. The width of the recess 992 in the left-right direction is set generally equal to the distance in the left-right direction between the stopper parts 966 formed on the left and right ends of the spring holding part 964. Therefore, normally, spring pressing parts 993 of the restricting wall 991, which define left and right ends of the recess 992, protrude into the recess 992, so as to overlap with the stopper parts 966 in the front-rear direction, and are held in contact with the left and right ends of the biasing member 98.

In this manner, by the biasing force of the biasing member 98 held between the spring pressing parts 993, the restricting member 96 is normally (in the non-pressed state) prevented from moving in the left-right direction, and held in a position (hereinafter referred to as a center position) where a center of the restricting member 96 in the left-right direction coincides with a center of the upper part 133 in the left-right direction.

At this time, as shown in FIG. 2, the trigger locking pieces 968 are located just behind the locking projections 140 of the trigger 14 which is located in the foremost position (off-position) (as shown by the solid line in FIG. 2) in the front-rear direction. Further, in the left-right direction, as shown in FIG. 5, the trigger locking pieces 968 are located in positions that are generally the same with positions of the locking projections 140. As described above, the trigger 14 can be turned in the front-rear direction along a prescribed moving path from the foremost position (off-position) to the rearmost position (not shown) via the on-position (shown by the dotted line in FIG. 2). When the restricting member 96 is located in the central position, however, the trigger locking pieces 968 are located on moving paths between the off-position and the on-position of the locking projections 140. Therefore, when the trigger 14 is pressed by the user, the trigger locking pieces 968 come into contact with the locking projections 140 from behind and prevent the trigger 14 from further moving rearward. In other words, the restricting member 96 prohibits the trigger 14 from moving to the on-position. For this reason, the center position of the restricting member 96 may also be referred to as the prohibiting position.

When the restricting member 96 is moved to the right or left against the biasing force of the biasing member 98, the trigger locking pieces 968 can be located in positions which are deviated to the right or left from the moving paths of the locking projections 140. Therefore, in such a case, when the trigger 14 is pressed by the user, the trigger 14 is allowed to move to the on-position since the trigger locking pieces 968 do not interfere with the locking projections 140. In other words, the restricting member 96 allows the trigger 14 to move to the on-position. For this reason, the position of the restricting member 96 when the trigger locking pieces 968 are deviated to the right or left from the moving paths of the locking projections 140 may also be referred to as the allowing position.

In the present embodiment, the restricting member 96 may be moved between the prohibiting position and the allowing position in response to a pressing operation by the user or a pressing operation by the interlocking member 91. However, whether the restricting member 96 is allowed to move between the prohibiting position and the allowing position or not depends on the position of the interlocking member 91, in other words, the operation mode selected with the mode switching dial 4. The operation of the trigger restricting mechanism 9 interlocked with the switching operation of the mode switching dial 4 is now described in detail.

First, a case in which the mode switching dial 4 is switched to the hammer drill position (a case in which the hammer drill mode is selected) is described with reference to FIGS. 2, 4 and 5.

When the mode switching dial 4 is switched to the hammer drill position, as shown in FIG. 4, the eccentric shaft 45 moves to an obliquely right front position with respect to the rotation center C on a rotating path 46. In interlock with this movement, the interlocking member 91 moves forward to a position that is close to the foremost position within the moving range. More specifically, the interlocking member 91 moves forward to a position in which the rear end of the interlocking member 91 is located within a front end portion of the passage 944 of the guide rib 943 (see FIG. 2). In this position, the interlocking member 91 is spaced apart forward from the restricting member 96 and does not extend into the locking passage 97. In other words, the interlocking member 91 is located in a position spaced apart from a moving path of the restricting member 96 between the prohibiting position and the allowing position (away from a region in which the interlocking member 91 may interfere with the restricting member 96 in the left-right direction). For this reason, the position of the interlocking member 91 as shown in FIG. 4 may also be referred to as a separate position.

When the interlocking member 91 is disposed in the separate position, as shown in FIG. 5, the restricting member 96 is held in the prohibiting position by the biasing force of the biasing member 98 and prohibits the trigger 14 from moving to the on-position. At the same time, the restricting member 96 is allowed to move to the allowing position in the left-right direction. Therefore, by pressing the left or right end portion of the restricting member 96, the user can deviate the trigger locking pieces 968 from the moving paths of the locking projections 140 and place the restricting member 96 in the allowing position, so that the prohibition of the movement of the trigger 14 to the on-position is cancelled. After placing the restricting member 96 in the allowing position, by pressing the trigger 14 to the on-position, the user can cause the hammer drill 1 to start the hammer drilling operation.

Further, as shown in FIG. 2, when the trigger 14 is disposed in the on-position (as shown by the dotted line), the locking projections 140 overlap with rear end portions of the trigger locking pieces 968 in the left-right direction (when seen from the left or right). The same is true when the trigger 14 is disposed in the rearmost position, although not shown. Therefore, even if the user releases the restricting member 96 while pressing the trigger 14, the side surfaces of the locking projections 140 come into contact with the side surfaces of the trigger locking pieces 968, so that the restricting member 96 is prohibited from returning to the prohibiting position by the biasing force of the biasing member 98. When the user releases the trigger 14, the trigger 14 is biased by the biasing spring 142 and turned forward back to the off-position. Accordingly, the restricting member 96 is returned to the prohibiting position by the biasing force of the biasing member 98.

Next, a case in which the mode switching dial 4 is switched to the trigger lock position (a case in which the trigger lock mode is selected) is described with reference to FIGS. 8 and 9.

Figure 8:
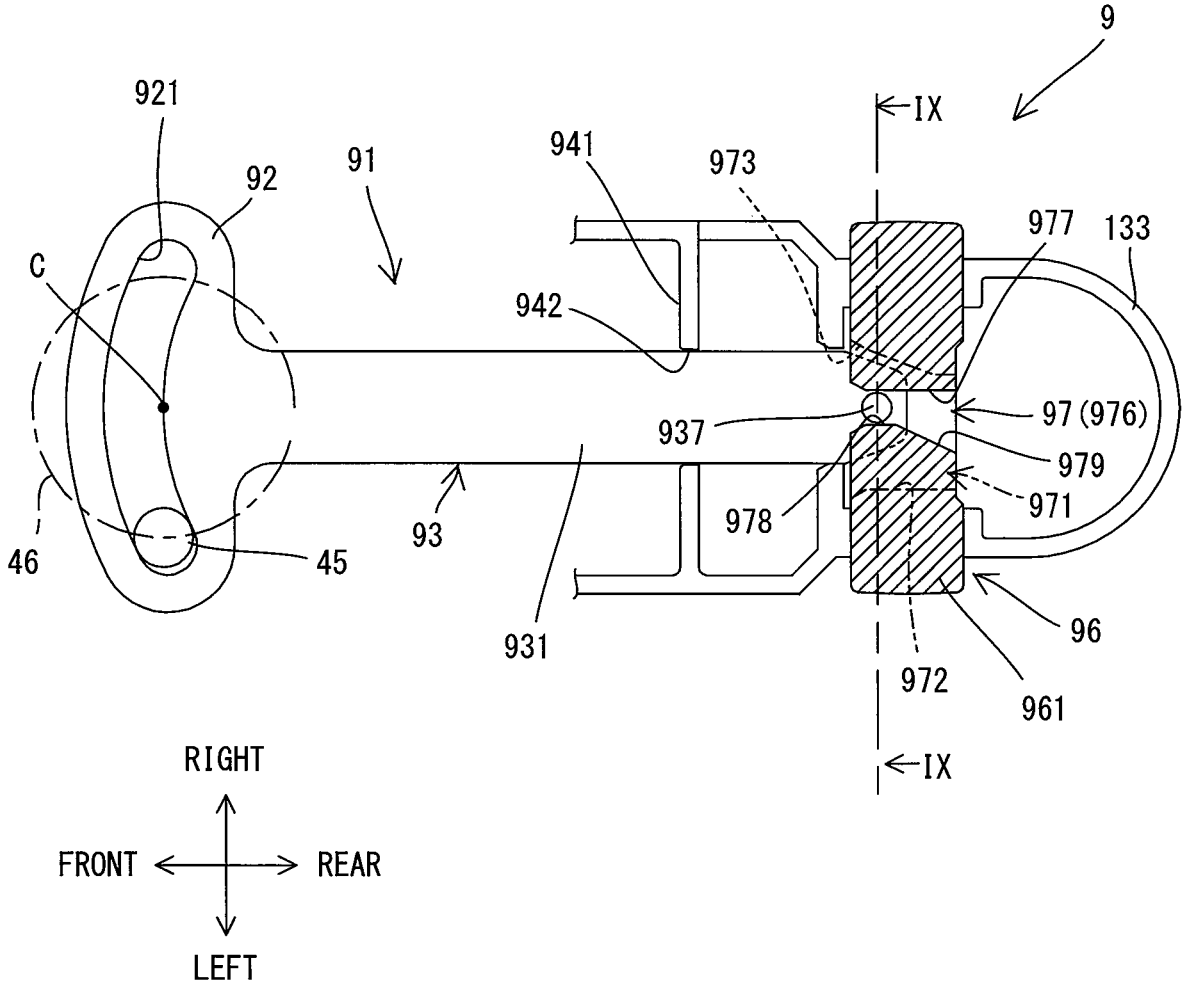
FIG. 8 is an explanatory drawing for illustrating an arrangement of the trigger restricting mechanism in a trigger lock mode.
Figure 9:
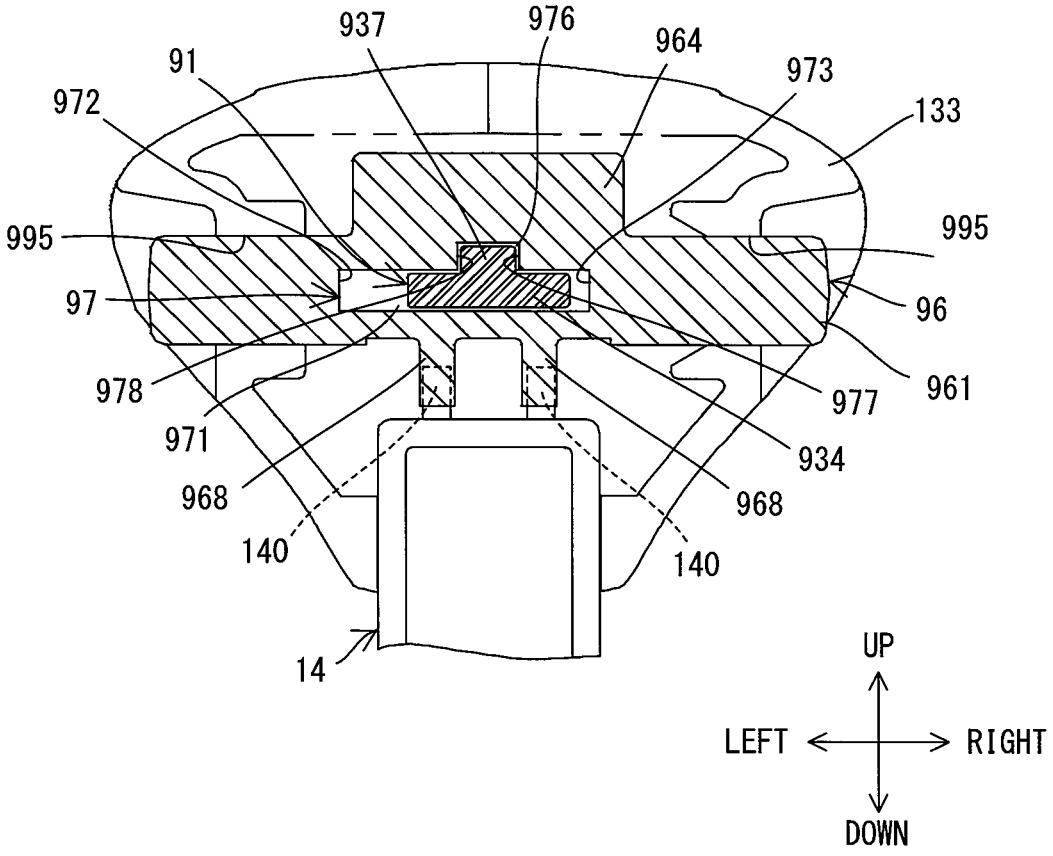
FIG. 9 is a sectional view taken along line IX-IX in FIG. 8, for illustrating the state of the restricting member when the interlocking member is disposed in an intermediate position.

When the mode switching dial 4 is switched from the hammer drill position to the trigger lock position, as shown in FIG. 8, the eccentric shaft 45 moves to a left position with respect to the rotation center C on the rotating path 46. In interlock with this movement, the interlocking member 91 moves rearward from the separate position (see FIG. 4) to an intermediate position located forward of a rearmost position within the moving range. In this process, the rear end portion of the interlocking member 91 enters the locking passage 97 of the restricting member 96 which is held in the prohibiting position (the center position). Further, in the present embodiment, the guide ribs 943 are arranged just in front of the restricting member 96. With this structure, the tapered part 934 is guided rearward through the passage 944 while its movement in the up-down direction is restricted by the guide ribs 943. Thus, the tapered part 934 can smoothly enter the locking passage 97. Further, the configuration of the locking passage 97 having the front open end portion enlarged in the up-down and left-right directions facilitates the entry of the tapered part 934 into the locking passage 97.

In the process that the interlocking member 91 moves to the intermediate position shown in FIG. 8, the tapered part 934 and the locking projection 937 respectively enter the first locking part 971 and the second locking part 976. At this time, the tapered part 934 enters between the tapered surface 973 and the vertical surface 972, through the open end portion of the first locking part 971. As described above, the distance between the tapered surface 973 and the vertical surface 972 is larger than the width of the straight part 931. Therefore, the tapered part 934 can move without interfering with the tapered surface 973 and the vertical surface 972. At the same time, the locking projection 937 moves rearward on the driving axis A1 and enters between the vertical surface 977 and the vertical surface 978, through the open end portion of the second locking part 976.

The interlocking member 91 reaches the intermediate position as shown in FIG. 8 without moving the restricting member 96 located in the prohibiting position (center position) in the left-right direction. Therefore, the restricting member 96 remains in the prohibiting position and prohibits the trigger 14 from moving to the on-position. In the intermediate position, as shown in FIGS. 8 and 9, the tapered part 934 is completely separated away from the tapered surface 973 and the vertical surface 972, while the locking projection 937 is slightly separated away from the vertical surface 977 and the vertical surface 978. Therefore, even if the user presses the left or right end portion of the restricting member 96, the locking projection 937 located on the moving path of the restricting member 96 comes into contact with the vertical surface 978 or 977 and prohibits the movement of the restricting member 96. In other words, unlike in the hammer drill mode, the prohibition of the movement of the trigger 14 to the on-position cannot be cancelled by the movement of the restricting member 96 to the allowing position. Thus, in the trigger lock mode, the state is maintained in which the movement of the trigger 14 to the on-position, that is, the driving of the tool accessory 18 itself, is prohibited.

Next, a case in which the mode switching dial 4 is switched to the hammer position (a case in which the hammer mode is selected) is described with reference to FIGS. 10 and 11.

Figure 10:
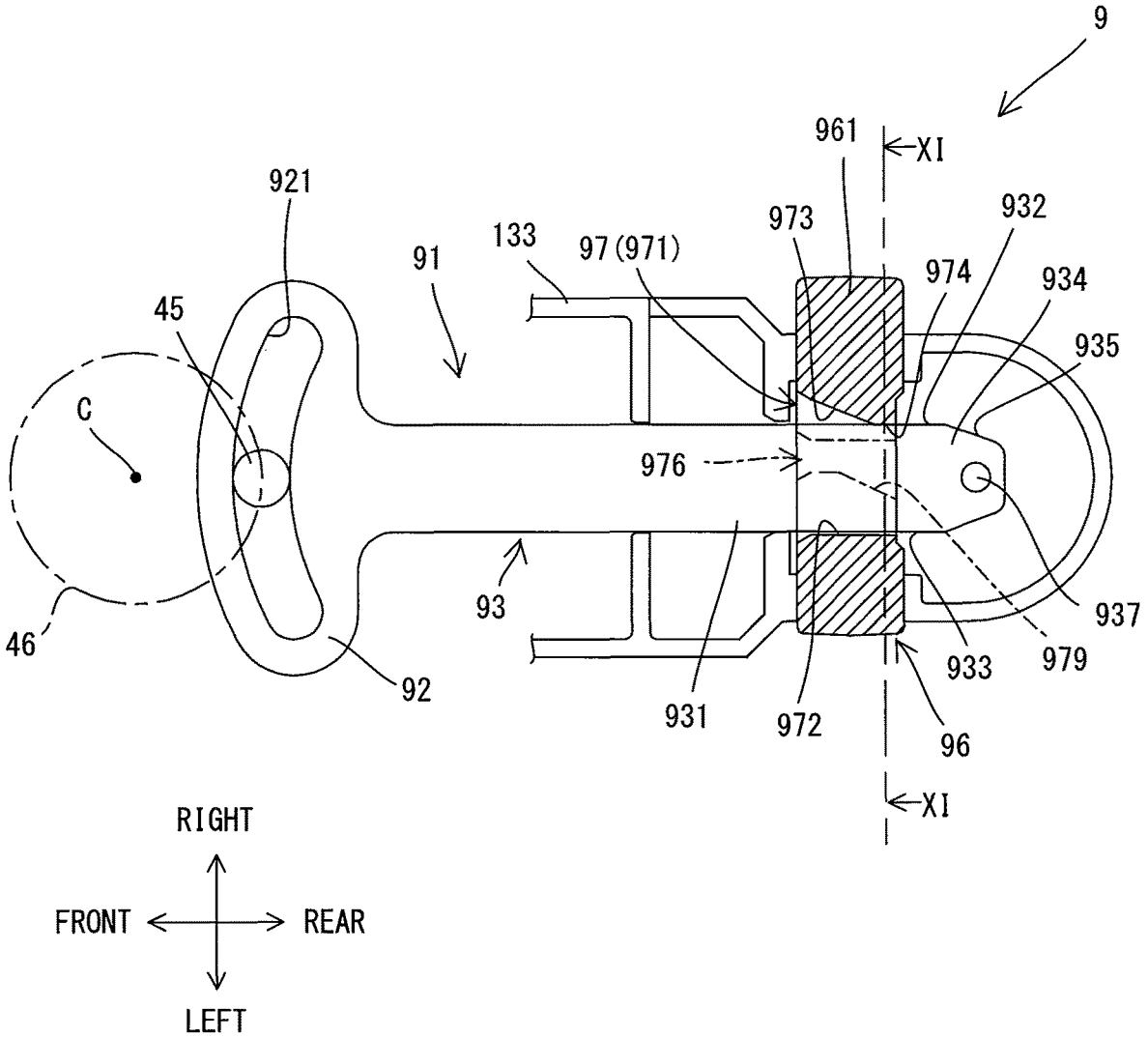
FIG. 10 is an explanatory drawing for illustrating an arrangement of the trigger restricting mechanism in a hammer mode.
Figure 11:
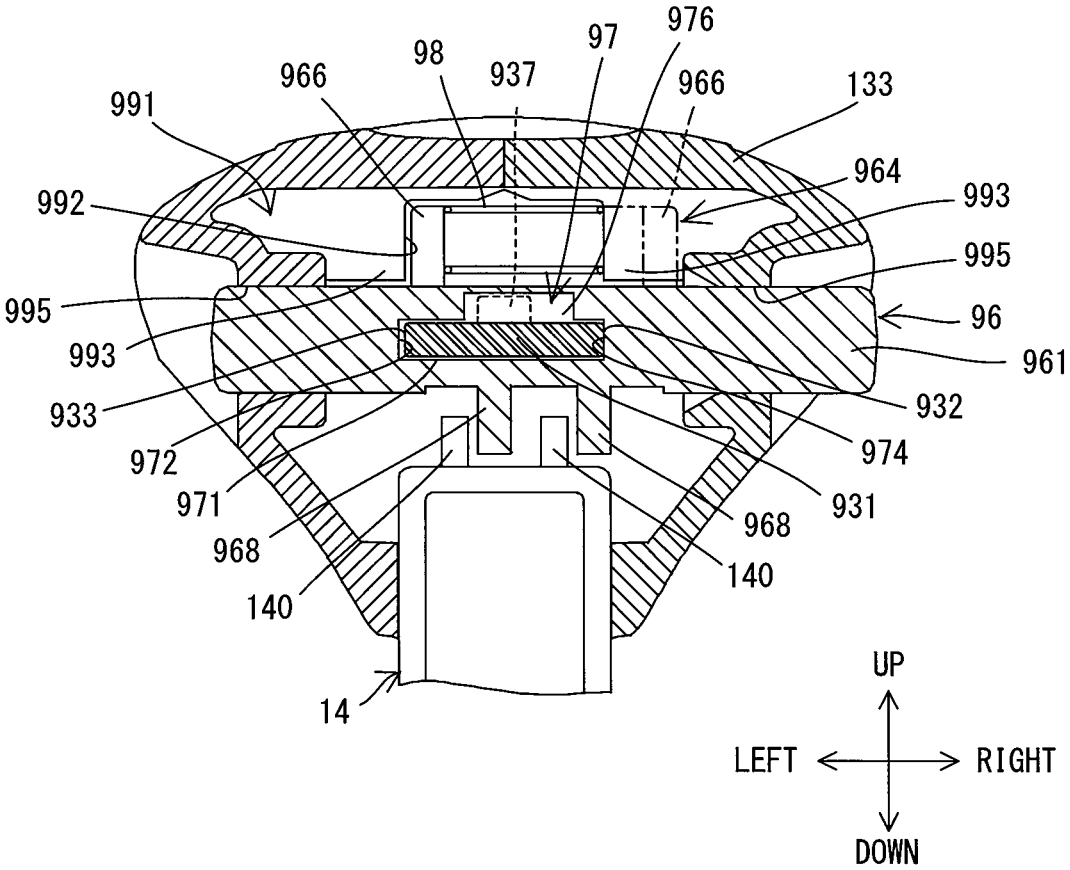
FIG. 11 is a sectional view taken along line XI-XI in FIG. 10, for illustrating the state of the restricting member when the interlocking member is disposed in a rearmost position.

When the mode switching dial 4 is switched from the trigger lock position to the hammer position, as shown in FIG. 10, the eccentric shaft 45 moves to a rearmost position on the rotating path 46. In interlock with this movement, the interlocking member 91 moves rearward to the rearmost position within the moving range. In this process, a right side surface (tapered surface) 935 of the tapered part 934 of the interlocking member 91 moves rearward in contact with the tapered surface 973 of the first locking part 971 in the locking passage 97, so that the interlocking member 91 causes the restricting member 96 to move to the right against the biasing force of the biasing member 98 (see FIG. 11). As a result, the restricting member 96, which has been located in the prohibiting position, is moved to the allowing position, in which the trigger locking pieces 968 are deviated from the moving paths of the locking projections 140. It is noted that the tapered surface 979 of the second locking part 976 serves as the escape surface, so that the locking projection 937 is avoided from interfering with the restricting member 96 when the restricting member 96 is moved.

Thereafter, the interlocking member 91 further moves rearward while the straight part 931 is held between the vertical surfaces 972, 974, and reaches the rearmost position as shown in FIG. 10. As shown in FIG. 11, the biasing member 98 is compressed between the left stopper part 966 of the spring holding part 964 and the right spring pressing part 993 of the restricting wall 991, so that the restricting member 96 is biased to the left toward the prohibiting position (the center position) by the biasing member 98. However, the right side surface 932 of the straight part 931 is held in contact with the vertical surface 974, and prevents the leftward movement of the restricting member 96. The same is true when the user presses the restricting member 96 to the left. Further, when the user presses the restricting member 96 to the right, the left side surface 933 of the straight part 931 comes into contact with the vertical surface 972 and prevents the rightward movement of the restricting member 96.

In this manner, in interlock with the switching operation of the mode switching dial 4 to the hammer position, the interlocking member 91 moves to the rearmost position while being in contact with the restricting member 96 and thereby causes the restricting member 96 to move from the prohibiting position to the allowing position. Further, by the contact with the restricting member 96 in the rearmost position, the interlocking member 91 prohibits the restricting member 96 from moving to the prohibiting position. Thus, in the hammer mode, the state is maintained in which the trigger 14 is allowed to move to the on-position. As a result, the user can cause the hammer drill 1 to start the hammering operation simply by pressing the trigger 14 to the on-position without the need for pressing the restricting member 96.

When the hammering operation is performed, the largest and most dominant vibration is caused in the first housing 11 in the driving axis A1 direction. As described above, in the present embodiment, the interlocking member 91 is connected to the mode switching dial 4 which is disposed on the first housing 11, while the restricting member 96 is held by the second housing 13 which is elastically connected to the first housing 11. When the first housing 11 vibrates, the interlocking member 91 also vibrates, but the second housing 13 does not vibrate in synchronization with the first housing 11.

To this end, in the present embodiment, as shown in FIG. 10, the straight part 931 is set longer in the driving axis A1 direction (the front-rear direction) than the body 961 of the restricting member 96 in the front-rear direction. When the interlocking member 91 is disposed in the rearmost position, the straight part 931 protrudes from the body 961 in the front-rear direction. Portions of the right and left side surfaces 932, 933 of the straight part 931 which protrude from the body 961 are configured as sliding surfaces which can slide in contact with the restricting member 96 (specifically, the vertical surfaces 974, 972) when the second housing 13 moves with respect to the first housing 11 in the driving axis A1 direction (the front-rear direction). Therefore, if the interlocking member 91 vibrates in the driving axis A1 direction, the restricting member 96 disposed in the second housing 13 can be prevented from moving to the prohibiting position and thus from prohibiting the trigger 14 from moving to the on-position.

When the mode switching dial 4 is switched from the hammer drill position to the hammer position, the interlocking member 91 moves to the rearmost position (see FIG. 10) via the intermediate position (see FIG. 8). Operations of the interlocking member 91 and the restricting member 96 in this process are combinations of the above-described operations. Further, when the mode switching dial 4 is switched from the hammer position to the trigger lock position or to the hammer drill position, the interlocking member 91 moves forward. When the tapered part 934 enters the first locking part 971 from the rear, the restricting member 96 is moved to the left by the biasing force of the biasing member 98. Then, when the interlocking member 91 reaches the intermediate position, the restricting member 96 returns to the center position and the locking projection 937 enters between the vertical surfaces 977, 978. The interlocking member 91 is further moved forward to the separate position (see FIG. 4) while the restricting member 96 is held in the center position.

As described above, in the hammer drill 1 of the present embodiment, the trigger restricting mechanism 9 can restrict the movement of the trigger 14 to the on-position in interlock with the switching operation of the mode switching dial 4. In the present embodiment, the trigger restricting mechanism 9 establishes a suitable state of the trigger 14 for any operation mode selected from among the hammer mode, the hammer drill mode and the trigger lock mode, so that the convenience of the hammer drill 1 can be improved.

Specifically, in the hammer mode, the user may operate the trigger 14 to drive the tool accessory 18 while shifting a chipping position little by little. In other words, the user may repeat pressing of the trigger 14 at short intervals. Therefore, in the hammer mode, the trigger 14 is allowed to move to the on-position by the trigger restricting mechanism 9. On the other hand, in the drill mode in which the tool accessory 18 is rotationally driven, the trigger 14 is prohibited from moving to the on-position, but the user can cancel the prohibition of the movement of the trigger 14 to the on-position by pressing the restricting member 96 when necessary. Furthermore, in the trigger lock mode for reliably keeping the switch 145 in the off-state, the trigger 14 is prohibited from moving to the on-position and the prohibition cannot be cancelled.

In the present embodiment, a structure for establishing the suitable state of the trigger 14 for each of the above-described operation modes is rationally realized by the interlocking member 91 which moves in interlock with the switching operation of the mode switching dial 4 and by the restricting member 96 which is held in the prohibiting position in the non-pressed state, while being moved from the prohibiting position to the allowing position by an external pressing operation.

In the present embodiment, the interlocking member 91 includes the straight part 931 and the tapered part 934 which are configured to come into contact with the first locking part 971 of the locking passage 97 in interlock with the switching operation of the mode switching dial 4 to the hammer position, and the locking projection 937 which is configured to come into contact with the second locking part 976 in interlock with the switching operation of the mode switching dial 4 to the trigger lock position. With this structure, the interlocking member 91 and the restricting member 96 come into contact with each other at their respectively different portions between the case when the mode switching dial 4 is switched to the hammer position and the case when the mode switching dial 4 is switched to the trigger lock position. With such a simple structure, two different functions (a function of moving the restricting member 96 to the allowing position and prohibiting the restricting member 96 from moving to the prohibiting position, and a function of prohibiting the restricting member 96 from moving to the allowing position) are realized.

Particularly, in the present embodiment, the straight part 931 and the tapered part 934 are arranged in different positions from the locking projection 937 in the up-down direction, which crosses the moving direction (the front-rear direction) of the interlocking member 91 as well as the moving direction of the restricting member 96 (the left-right direction). Further, the first locking part 971 and the second locking part 976 are also arranged in different positions from each other in the up-down direction (specifically, as different portions of the single locking passage 97). With this structure, contact portions between the interlocking member 91 and the restricting member 96 can be provided without increasing the size of the interlocking member 91 and the restricting member 96 in their respective moving directions. Further, the interlocking member 91 can move between the separate position, the trigger lock position and the hammer position simply by linearly moving in the driving axis A1 direction in interlock with the switching operation of the mode switching dial 4. Therefore, the trigger restricting mechanism 9 can be made compact in a direction other than the driving axis A1 direction.

Further, in the present embodiment, the trigger restricting mechanism 9 includes the biasing member 98 which biases and holds the restricting member 96 in the prohibiting position (the center position). The restricting member 96 is configured to be movable in the left-right direction crossing the driving axis A1 and configured such that the left and right end portions of the restricting member 96 can be pressed by the user. Further, the allowing positions are provided on both sides of the prohibiting position in the left-right direction. Therefore, when the restricting member 96 is held in the prohibiting position by the biasing member 98, the user can move the restricting member 96 to either of the allowing positions by pressing the restricting member 96 from either the right or left side in order to move the trigger 14 to the on-position. Thus, the operability of the restricting member 96 can be improved.

Correspondences between the features of the embodiment and the features of the invention are as follows. The hammer drill 1 is an example that corresponds to the "work tool" according to the present invention. The hammer drill mode, the hammer mode and the trigger lock mode are examples that correspond to the "drill mode", the "hammer mode" and the "drive prohibition mode", respectively, according to the present invention. The switch 145 is an example that corresponds to the "switch" according to the present invention. The trigger 14 is an example that corresponds to the "operation member" according to the present invention. The off-position and the on-position of the trigger 14 are examples that correspond to the "off-position" and the "on-position", respectively, according to the present invention. The mode switching dial 4 is an example that corresponds to the "mode switching member" according to the present invention. The hammer drill position, the hammer position and the trigger lock position are examples that correspond to the "drill mode position", the "hammer mode position" and the "drive prohibition mode position", respectively, according to the present invention.

The trigger restricting mechanism 9 is an example that corresponds to the "movement restricting mechanism" according to the present invention. The restricting member 96 is an example that corresponds to the "restricting member" according to the present invention. The prohibiting (center) position and the allowing position of the restricting member 96 are examples that correspond to the "prohibiting position" and the "allowing position", respectively, according to the present invention. The first locking part 971 and the second locking part 976 are examples that correspond to the "first contacted part" and the "second contacted part", respectively, according to the present invention. The interlocking member 91 is an example that corresponds to the "interlocking member" according to the present invention. The separate position, the rearmost position and the intermediate position of the interlocking member 91 are examples that correspond to the "separate position", the "first contact position" and the "second contact position", respectively, according to the present invention. The straight part 931 and the tapered part 934 as a whole is an example that corresponds to the "first contact part" according to the present invention. The locking projection 937 is an example that corresponds to the "second contact part" according to the present invention. The biasing member 98 is an example that corresponds to the "biasing member" according to the present invention.

The driving mechanism 3 is an example that corresponds to the "driving mechanism" according to the present invention. The first housing 11 and the second housing 13 are examples that correspond to the "first housing" and the "second housing", respectively, according to the present invention. The grip part 131 is an example that corresponds to the "grip part" according to the present invention. Each of the first springs 71 and the second spring 75 is an example that corresponds to the "elastic element" according to the present invention. The right side surface 932 and the left side surface 933 of the straight part 931 are examples that correspond to the "sliding part" according to the present invention.

The above-described embodiment is a mere example and a work tool according to the present invention is not limited to the structure of the hammer drill 1 of the above-described embodiment. For example, the following modifications may be made. Further, one or more of these modifications may be used in combination with the hammer drill 1 of the above-described embodiment or the claimed invention.

The work tool in which any one of a plurality of operation modes is selectable and which is configured to operate according to the selected operation mode is not limited to the hammer drill 1. Further, the selectable operation modes are not limited to the hammer mode, the hammer drill mode and the trigger lock mode. For example, the selectable operation modes may include: the hammer mode for performing only the hammering operation; the hammer drill mode for performing the hammering operation and the drilling operation; and a drill mode for performing only the drilling operation. In the drill mode, the trigger restricting mechanism 9 may operate in the same manner as in the hammer drill mode. Further, either one of the hammer mode and the drill mode may be selectable, or either one of the hammer drill mode and the trigger lock mode may be selectable. Further, in place of the mode switching dial 4 which is turned (rotated) to switch between the switching positions, a mode switching lever may be employed which is configured to be moved linearly in a prescribed direction.

Further, in the above-described embodiment, the rechargeable battery 19 is employed as a power source, but the work tool may be connected to an external power source via a power cable. In the case of the work tool using the battery 19 as the power source instead of the external power source, the battery 19 may be left mounted even when the work tool is not in use. In such a case, the trigger 14 may be pressed for some cause, so that the tool accessory 18 may be accidentally driven. Therefore, the present invention can be suitably applied to a work tool which is powered by the battery 19. When the battery 19 is employed as the power source, the number of the battery mounting parts 15 (the maximum number of the batteries 19 to be mounted) may be one or three or more. Further, the structure of the driving mechanism 3 which is powered by the motor 2 to drive the tool accessory 18 may also be appropriately modified. For example, in place of the above-described crank mechanism, the motion converting mechanism 30 may be of the type that is configured to convert a rotational motion of the motor 2 into a linear motion by using a swinging member.

The structure of the housing 10 is not limited to the structure of the above-described embodiment, but may be appropriately modified or changed. For example, the shapes of the first housing 11 and the second housing 13 which is movably connected to the first housing 11 via the elastic element, and the structures, the numbers and the positions of the elastic element (the first springs 71, the second spring 75) and the sliding guide (the upper sliding part 81, the lower sliding part 82) may be appropriately changed. Further, it is preferable for the housing 10 to have a vibration-isolation housing structure, but it is not essential.

The structure of the trigger restricting mechanism 9 may also be appropriately changed. For example, the shape of the interlocking member 91, the connection manner of the interlocking member 91 with the mode switching dial 4 and the operation manner of the interlocking member 91 with respect to the restricting member 96 are not limited to those of the above-described embodiment, as long as the interlocking member 91 is configured to move in interlock with a switching operation of the mode switching dial 4 and to prohibit or allow the movement of the trigger 14 to the on-position in cooperation with the restricting member 96. Similarly, the shape of the restricting member 96, the arrangement of the restricting member 96 with respect to the interlocking member 91, and the engagement between the restricting member 96 and the trigger 14 are not limited to those of the above-described embodiment, as long as the restricting member 96 is configured to move between the prohibiting position in which the trigger 14 is prohibited from moving to the on-position and the allowing position in which the trigger 14 is allowed to move to the on-position, in response to an external pressing operation (pressing operation by the user or pressing operation by the interlocking member 91).

For example, in the above-described embodiment, the restricting member 96 is disposed to be movable from the prohibiting position to either of the allowing positions provided on the both sides of the prohibiting position in the left-right direction, and the interlocking member 91 moves the restricting member 96 and prohibits the movement of the restricting member 96 by entering the locking passage 97 extending through the restricting member 96 in the front-rear direction. In place of this structure, for example, the allowing position may be provided on only one side of the prohibiting position in the left-right direction. In this case, the restricting member 96 may be biased inward in the upper part 133 by the biasing member and held in the prohibiting position in the non-pressed state (when not pressed), and as the interlocking member 91 is moved rearward, the restricting member 96 may be moved outward to the allowing position by the interlocking member 91. Further, the structure of the restricting member 96 which is configured to be movable between the prohibiting position and the allowing position may be, for example, of the type that projects from and retracts into the upper part 113 in the up-down direction, or the type that rotates in the up-down direction around a rotation axis extending in the left-right direction, in place of the sliding type of the above-described embodiment.

Further, in the above-described embodiment, the restricting member 96 is disposed on the moving path of the trigger 14 and prohibits the trigger 14 from moving to the on-position by contact with the trigger 14 when the trigger 14 is moved slightly rearward. The manner of prohibiting the movement of the trigger 14 is not limited to this, but it may include a manner that the restricting member 96 makes contact with the trigger 14 disposed in the off-position and immovably holds the trigger 14, and a manner that the restricting member 96 acts upon a different member such that the different member comes into contact with the trigger 14.

In view of the natures of the present invention and the above-described embodiment, the following features can be provided. Each of the features can be employed in combination with any of the hammer drill 1 of the above-described embodiment, the above-described modifications and the claimed invention.

(Aspect 1)

The interlocking member may be configured to be movable in a direction of a driving axis and has a first inclined surface inclined with respect to the driving axis, the restricting member may be configured to be movable in a direction crossing the driving axis and has a second inclined surface, which is configured to come into contact with the first inclined surface, and the interlocking member may be configured to move in the direction of the driving axis in a state in which the first inclined surface is in contact with the second inclined surface, in interlock with the switching operation of the mode switching member to the hammer mode position, thereby causing the restricting member to move to the allowing position.

(Aspect 2)

The first contacted part may comprise a first passage extending through the restricting member in a moving direction of the interlocking member, the second contacted part may comprise a second passage extending through the restricting member in the moving direction of the interlocking member and having a different width from the first passage, the first contact part may be configured to pass through the first passage and configured to move to the first contact position while being in contact with a wall surface of the first passage, in interlock with the switching operation of the mode switching member to the hammer mode position, thereby causing the restricting member to move to the allowing position, and to be in contact with the wall surface of the first passage in the first contact position, thereby prohibiting the restricting member from moving to the prohibiting position, and the second contact part may have a different width from the first contact part, may be configured to pass through the second passage, and configured to move to the second contact position on a moving path of the restricting member in interlock with the switching operation of the mode switching member to the drive prohibition mode position, and to be in contact with a wall surface of the second passage in the second contact position, thereby prohibiting the restricting member from moving to the allowing position.

(Aspect 3)

The work tool may further include a battery mounting part and a battery that is removably mounted to the battery mounting part.

(Aspect 4)

The restricting member may include a locking part, and the restricting member may be configured such that, in the prohibiting position, the locking part is disposed on a moving path between the off-position and the on-position of the operation member, and in the allowing position, the locking part is disposed in a position deviated from the moving path of the operation member.

DESCRIPTION OF THE NUMERALS

1: hammer drill, 10: housing, 11: first housing, 111: motor housing part, 117: driving mechanism housing part, 13: second housing, 131: grip, 133: upper part, 134: recess, 135: opening, 137: lower part, 138: front lower end part, 139: rear lower end part, 14: trigger, 140: locking projection, 141: support shaft, 142: biasing spring, 145: switch, 15: battery mounting part, 18: tool accessory, 19: battery, 2: motor, 25: motor shaft, 29: driving gear, 3: driving mechanism, 30: motion converting mechanism, 31: crank shaft, 32: connecting rod, 33: piston, 34: tool holder, 35: cylinder, 36: striking mechanism, 361: striker, 363: impact bolt, 365: air chamber, 38: rotation transmitting mechanism, 39: clutch, 4: mode switching dial, 401: mark, 403: mark, 405: mark, 41: tab, 43: pointer, 45: eccentric shaft, 46: rotating path, 5: controller, 71: first spring, 75: second spring, 81: upper sliding part, 82: lower sliding part, 9: trigger restricting mechanism, 91: interlocking member, 92: connection part, 921: guide hole, 93: actuation part, 931: straight part, 932: right side surface, 933: left side surface, 934: tapered surface, 935: right side surface, 937: locking projection, 941: guide wall, 942: passage, 943: guide rib, 944: passage, 96: restricting member, 961: body, 964: spring holding part, 965: recess, 966: stopper part, 968: trigger locking piece, 97: locking passage, 971: first locking part, 972: vertical surface, 973: tapered surface, 974: vertical surface, 976: second locking part, 977: vertical surface, 978: vertical surface, 979: tapered surface, 8: biasing member, 991: restricting wall, 992: recess, 993: spring pressing part, 995: through hole, A1: driving axis, A2: rotation axis, C: rotation center

What is claimed is:

1. A work tool, in which any one of a plurality of operation modes is selectable and which is configured to operate according to the selected operation mode, the work tool comprising:

a switch for driving a tool accessory;

an operation member configured to be held in an off-position in a non-pressed state and configured to move to an on-position in response to an external pressing operation, the operation member in the off-position placing the switch in an off-state, the operation member in the on-position placing the switch in an on-state;

a mode switching member configured to be switched between a plurality of switching positions in response to an external operation, the switching positions respectively corresponding to the operation modes; and a movement restricting mechanism configured to restrict movement of the operation member from the off-position to the on-position when the mode switching member is in one or more, but less than all, of the plurality of switching positions; wherein:

the plurality of operation modes include a hammer mode and a drill mode, only a hammering operation of linearly driving the tool accessory in a direction of a prescribed driving axis being performed in the hammer mode, at least a drilling operation of rotationally driving the tool accessory around the driving axis being performed in the drill mode, the plurality of switching positions include a hammer mode position and a drill mode position, the hammer mode position and the drill mode position respectively corresponding to the hammer mode and the drill mode;

the movement restricting mechanism is configured to allow the movement of the operation member to the on-position when the mode switching member is in the hammer mode position; and the movement restricting mechanism is configured to prohibit the movement of the operation member to the on-position when the mode switching member is in the drill mode position, while allowing prohibition of the movement to be cancelled in response to an external operation.

2. The work tool as defined in claim 1, wherein:

the movement restricting mechanism includes:

a restricting member configured to be held in a prohibiting position in a non-pressed state and configured to move from the prohibiting position to an allowing position in response to an external pressing operation, the restricting member prohibiting the movement of the operation member to the on-position in the prohibiting position and allowing the movement of the operation member to the on-position in the allowing position; and an interlocking member configured to move in interlock with the switching operation of the mode switching member, and the interlocking member is configured to move to a separate position spaced apart from a moving path of the restricting member in interlock with the switching operation of the mode switching member to the drill mode position, thereby allowing the restricting member to move to the allowing position in response to the pressing operation.

3. The work tool as defined in claim 2, wherein:

the movement restricting mechanism includes a biasing member configured to bias the restricting member so as to hold the restricting member in the prohibiting position, the restricting member is configured to be movable in a prescribed direction, and configured such that both ends of the restricting member in the prescribed direction are subject to the pressing operation, the prescribed direction crossing the driving axis, and the allowing position is provided on each side of the prohibiting position in the prescribed direction.

4. The work tool as defined in claim 2, wherein:

the interlocking member is configured to move in contact with the restricting member to a first contact position on the moving path of the restricting member in interlock with the switching operation of the mode switching member to the hammer mode position, thereby causing the restricting member to move to the allowing position, and the interlocking member is further configured to be in contact with the restricting member in the first contact position, thereby prohibiting the restricting member from moving to the prohibiting position.

5. The work tool as defined in claim 4, wherein:

the interlocking member is configured to be movable in the direction of the driving axis and has a first inclined surface, the first inclined surface inclined with respect to the driving axis, the restricting member is configured to be movable in a direction crossing the driving axis and has a second inclined surface, the second inclined surface being configured to come into contact with the first inclined surface, and the interlocking member is configured to move in the direction of the driving axis in a state in which the first inclined surface is in contact with the second inclined surface, in interlock with the switching operation of the mode switching member to the hammer mode position, thereby causing the restricting member to move to the allowing position.

6. The work tool as defined in claim 5, wherein:

the interlocking member has a first vertical surface, the first vertical surface extending generally perpendicular to a moving direction of the restricting member, the restricting member has a second vertical surface, the second vertical surface extending generally perpendicular to the moving direction of the restricting member, and the interlocking member is configured such that the first vertical surface is in contact with the second vertical surface in the first contact position, thereby prohibiting the the restricting member from moving to the prohibiting position.

7. The work tool as defined in claim 4, further comprising:

a driving mechanism configured to drive the tool accessory;

a first housing that houses the driving mechanism; and a second housing including a grip part configured to be held by a user, the second housing being connected to the first housing via an elastic element so as to be movable in the direction of the driving axis relative to the first housing, wherein:

the interlocking member is connected in an interlocking manner to the mode switching member provided to the first housing, the restricting member is provided to the second housing so as to be movable in a direction crossing the driving axis, and the interlocking member includes a sliding part, the sliding part being configured to slide in the direction of the driving axis relative to the restricting member when the second housing moves relative to the first housing in the direction of the driving axis in a state in which the interlocking member is disposed in the first contact position in the hammer mode.

8. The work tool as defined in claim 1, wherein:

the operation modes include a drive prohibition mode, driving of the tool accessory being prohibited in the drive prohibition mode, the switching positions include a drive prohibition mode position corresponding to the drive prohibition mode, and the movement restricting mechanism is configured to prohibit the movement of the operation member to the on-position in interlock with a switching operation of the mode switching member to the drive prohibition mode position, while not allowing prohibition of the movement to be cancelled.

9. The work tool as defined in claim 1, wherein:

the movement restricting mechanism includes:

a restricting member configured to be held in a prohibiting position in a non-pressed state and configured to move from the prohibiting position to an allowing position in response to an external pressing operation, the restricting member prohibiting the movement of the operation member to the on-position in the prohibiting position and allowing the movement of the operation member to the on-position in the allowing position; and an interlocking member configured to move in interlock with the switching operation of the mode switching member;

the interlocking member is configured to move to a separate position spaced apart from a moving path of the restricting member in interlock with the switching operation of the mode switching member to the drill mode position, thereby allowing the restricting member to move to the allowing position in response to the pressing operation;

the interlocking member is configured to move in contact with the restricting member to a first contact position on the moving path of the restricting member in interlock with the switching operation of the mode switching member to the hammer mode position, thereby causing the restricting member to move to the allowing position and prohibiting the restricting member from moving to the prohibiting position;

the interlocking member is configured to move to a second contact position on the moving path of the restricting member in interlock with the switching operation of the mode switching member to the drive prohibition mode position; and the interlocking member is further configured to be in contact with the restricting member in the second contact position, thereby prohibiting the restricting member from moving to the allowing position.

10. The work tool as defined in claim 9, wherein:

the restricting member includes:

a first contacted part; and a second contacted part different from the first contacted part, and the interlocking member includes:

a first contact part configured to come into contact with the first contacted part in interlock with the switching operation of the mode switching member to the hammer mode position; and a second contact part configured to come into contact with the second contacted part in interlock with the switching operation of the mode switching member to the drive prohibition mode position.

11. The work tool as defined in claim 10, wherein:

the first and second contacted parts are disposed in different positions of the restricting member in a crossing direction, the crossing direction crossing a moving direction of the restricting member as well as a moving direction of the interlocking member, and the first and second contact parts are disposed in different positions of the interlocking member in the crossing direction.

12. The work tool as defined in claim 11, wherein:

the interlocking member is configured to move in the direction of the driving axis, the restricting member is configured to move in an axial direction of a first axis, the first axis extending generally perpendicularly to the driving axis, the first contacted part comprises a first passage, the first passage extending through the restricting member in the direction of the driving axis, the second contacted part comprises a second passage, the second passage communicating with the first passage in an axial direction of a second axis, the second axis being perpendicular to the driving axis as well as the first axis, the second passage extending through the restricting member in the direction of the driving axis, the second passage having a different width from the first passage, the first contact part is an elongate member extending in the direction of the driving axis and configured to pass through the first passage, and the second contact part is a projection protruding from the first contact part in the axial direction of the second axis and configured to pass through the second passage.

13. The work tool as defined in claim 10, wherein:

the first contacted part comprises a first passage extending through the restricting member in a moving direction of the interlocking member, the second contacted part comprises a second passage extending through the restricting member in the moving direction of the interlocking member, the second passage having a different width from the first passage, the first contact part is configured to pass through the first passage, the first contact part is configured to move to the first contact position in a state in which the first contact part is in contact with a wall surface of the first passage, in interlock with the switching operation of the mode switching member to the hammer mode position, thereby causing the restricting member to move to the allowing position, the first contact part is further configured to be in contact with the wall surface of the first passage in the first contact position, thereby prohibiting the restricting member from moving to the prohibiting position, the second contact part has a different width from the first contact part, the second contact part is configured to pass through the second passage, the second contact part is configured to move to the second contact position on the moving path of the restricting member, in interlock with the switching operation of the mode switching member to the drive prohibition mode position, and the second contact part is further configured to be in contact with a wall surface of the second passage in the second contact position, thereby prohibiting the movement of the restricting member to the allowing position.

14. The work tool as defined in claim 13, wherein:

the interlocking member is configured to move in the direction of the driving axis, the restricting member is configured to move in a direction crossing the driving axis, the first contact part includes:

a first vertical surface extending generally perpendicularly to a moving direction of the restricting member; and a first inclined surface inclined with respect to the driving axis, the wall surface of the first passage includes:

a second vertical surface extending generally perpendicularly to the moving direction of the restricting member; and a second inclined surface inclined with respect to the driving axis, the second inclined surface being configured to make contact with the first inclined surface, the first inclined surface is configured to move in contact with the second inclined surface to the first contact position in interlock with the switching operation of the mode switching member to the hammer mode position, thereby causing the restricting member to move to the allowing position, and the first vertical surface is configured to be in contact with the second vertical surface in the first contact position, thereby prohibiting the restricting member from moving to the prohibiting position.

15. The work tool as defined in claim 14, wherein the second contact part is a projection protruding from the first contact part.

16. The work tool as defined in claim 9, wherein the interlocking member is configured to linearly move in the direction of the driving axis between the separate position, the first contact position and the second contact position, in interlock with the switching operation of the mode switching member.

17. The work tool as defined in claim 16, the restricting member is configured to move in a direction generally perpendicular to the driving axis.

18. A work tool, in which any one of a plurality of operation modes is selectable and which is configured to operate according to the selected operation mode, the work tool comprising:

a switch for driving a tool accessory;

an operation member configured to be held in an off-position in a non-pressed state and configured to move to an on-position in response to an external pressing operation, the operation member in the off-position placing the switch in an off-state, the operation member in the on-position placing the switch in an on-state;

a mode switching member configured to be switched between a plurality of switching positions in response to an external operation, the switching positions respectively corresponding to the operation modes; and a movement restricting mechanism configured to restrict movement of the operation member from the off-position to the on-position when the mode switching member is in one or more, but less than all, of the plurality of switching positions; wherein:

the operation modes include a drive prohibition mode, driving of the tool accessory being prohibited in the drive prohibition mode, the switching positions include a drive prohibition mode position corresponding to the drive prohibition mode, the movement restricting mechanism is configured to prohibit the movement of the operation member to the on-position in interlock with a switching operation of the mode switching member to the drive prohibition mode position, while not allowing prohibition of the movement to be cancelled, the movement restricting mechanism includes:

a restricting member configured to be held in a prohibiting position in a non-pressed state and configured to move from the prohibiting position to an allowing position in response to an external pressing operation, the restricting member prohibiting the movement of the operation member to the on-position in the prohibiting position and allowing the movement of the operation member to the on-position in the allowing position; and an interlocking member configured to move in interlock with the switching operation of the mode switching member, the interlocking member is configured to move to a second contact position on the moving path of the restricting member in interlock with the switching operation of the mode switching member to the drive prohibition mode position, and the interlocking member is further configured to be in contact with the restricting member in the second contact position, thereby prohibiting the restricting member from moving to the allowing position.

* * * * *